US005510803A

United States Patent [19]

Ishizaka et al.

[11] Patent Number: 5,510,803

[45] Date of Patent: Apr. 23, 1996

[54] DUAL-POLARIZATION PLANAR ANTENNA

[75] Inventors: Hironori Ishizaka; Shigetoo Wakushima; Hisayoshi Mizugaki; Masahiko Ohta, all of Ibaragi, Japan

[73] Assignee: Hitachi Chemical Company, Ltd., Tokyo, Japan

[21] Appl. No.: 347,211

[22] Filed: Nov. 21, 1994

Related U.S. Application Data

[63] Continuation of Ser. No. 977,792, Nov. 17, 1992, abandoned.

[30] Foreign Application Priority Data

| | | | |
|---|---|---|---|
| Nov. 26, 1991 | [JP] | Japan | 3-309533 |
| Nov. 29, 1991 | [JP] | Japan | 3-316250 |
| Dec. 10, 1991 | [JP] | Japan | 3-325672 |
| Mar. 17, 1992 | [JP] | Japan | 4-060176 |

[51] Int. Cl.[6] ..... H01Q 1/38; H01Q 21/24

[52] U.S. Cl. ..... 343/700 MS; 343/846

[58] Field of Search ..... 343/700 MS, 846, 343/853; H01Q 1/38, 21/24, 21/26

[56] References Cited

U.S. PATENT DOCUMENTS

| | | | |
|---|---|---|---|
| 4,131,894 | 12/1978 | Schlawne | 343/700 MS |
| 4,170,013 | 10/1979 | Black | 343/700 MS |
| 4,614,947 | 9/1986 | Rammos | 343/778 |
| 4,816,835 | 3/1989 | Abiko et al. | 343/700 MS |
| 4,857,938 | 8/1989 | Tsukamoto et al. | 343/700 MS |
| 4,926,189 | 5/1990 | Zaghloul et al. | 343/700 MS |
| 4,929,959 | 5/1990 | Sorbello et al. | 343/700 MS |
| 5,061,943 | 10/1991 | Rammos | 343/778 |

FOREIGN PATENT DOCUMENTS

| | | |
|---|---|---|
| 0433255 | 6/1991 | European Pat. Off. . |
| 3729750 | 3/1988 | Germany . |
| 3917138 | 12/1989 | Germany . |

OTHER PUBLICATIONS

Das, N. K. et al., "Printed Antennas in Multiple Layers: General Considerations and Infinite Array Analysis by a Unified Method", ICAP Conference Publication No. 301, Part 1: Antennas, pp. 364–368, U. Mass, 1989.

"Analysis and Solution of the Parallel Plate Mode by the Use of the Spatial Circuit Network Method", Toshiba Research and Development Center, A.P91–35, Jun. 20, 1991.

"Study on Dual–Polarization Planar Antenna", prepared for 1990 Springtime National Conference of Electronics, Information, and Communication Society (N.C.E.I.C.S.) Japan, Paper No. 8133.

"Dual Polarazation Flat Plate Antenna for Communication Satellite," prepared for 1992 Springtime N.C.E.I.C.S. Japan, Paper B–123.

(List continued on next page.)

*Primary Examiner*—Michael C. Wimer

*Attorney, Agent, or Firm*—Sandler, Greenblum & Bernstein

[57] ABSTRACT

A dual-polarization planar antenna includes: a first feeding substrate having a plurality of first radiation elements and a first feeding line; a first dielectric member; a first ground conductor having a plurality of slots; a second dielectric member; a second feeding substrate having a plurality of second radiation elements and a second feeding line; a third dielectric member; and a second ground conductor. The first feeding substrate, the first dielectric member, the first ground conductor, the second dielectric member, the second feeding substrate, the third dielectric member, and the second ground conductor are successively superposed in this order. The first feeding substrate, the first ground conductor, and the second feeding substrate are arranged so that the slots, the first radiation elements, and the second radiation elements are overlapped with one another at the same positions. The first and the second feeding substrates are arranged so that the first radiation elements are excited by the first feeding line in a first excitation direction while the second radiation elements are excited by the second feeding line in a second excitation direction perpendicular to the first excitation direction.

48 Claims, 17 Drawing Sheets

OTHER PUBLICATIONS

"Radiation Characterisics of Dual–Polarazation Planar Array", prepared for 1990 Autumnal N.C.E.I.C.S., Japan, paper B–93.

"Radiation Properties of Triplate Feed Type Patch Antennas", prepared for 1991 Springtime N.C.E.I.C.S., Japan, Paper No. B–102.

"A Waveguide–fed Parallel Plate Slot Array Antenna for Dual Polarazation Use", prepared for 1992 N.C.E.I.C.S., Japan, Paper No. B–112.

"A Triplate Feed Type Planar Antenna", prepared for 1991 Springtime N.C.E.I.C.S., Japan, Paper No. B–103.

RADIATION IMPEDANCE OF RADIATION ELEMENT 7

RADIATION IMPEDANCE OF RADIATION ELEMENT 3 (R COMPONENT, jx (REACTANCE) COMPONENT)

GAIN OF ELEMENT WHEN X=Y=0.3λ0

GAIN OF ELEMENT WHEN X=Y=0.4λ0

FIG. 13A
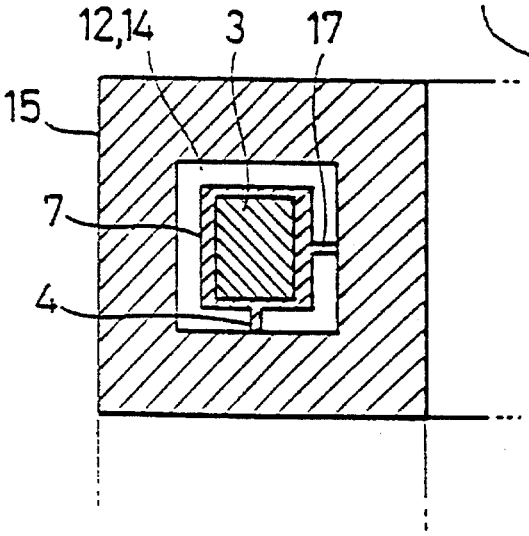
POLARIZATION RADIATED FROM UPPER PATCHES
FIG. 13B
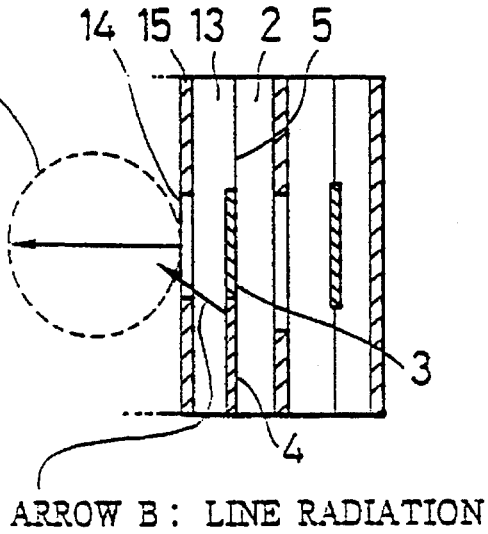
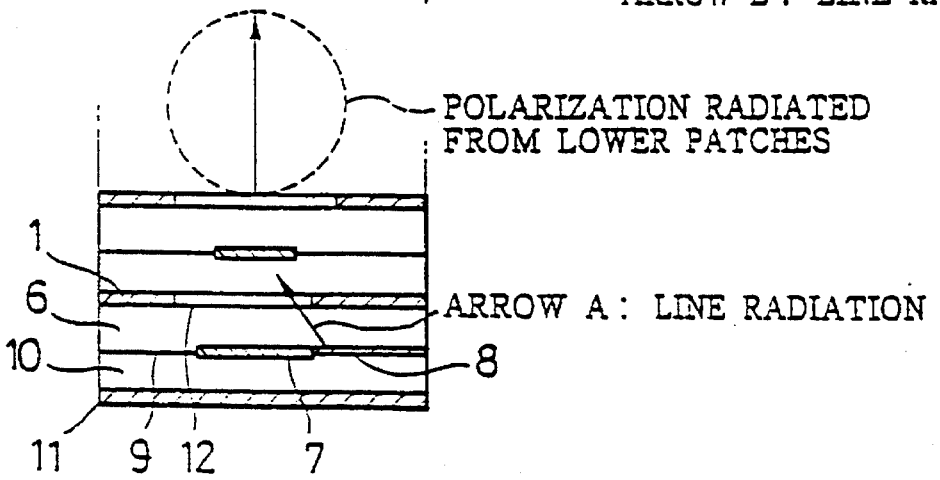
FIG. 13c FIG. 16A
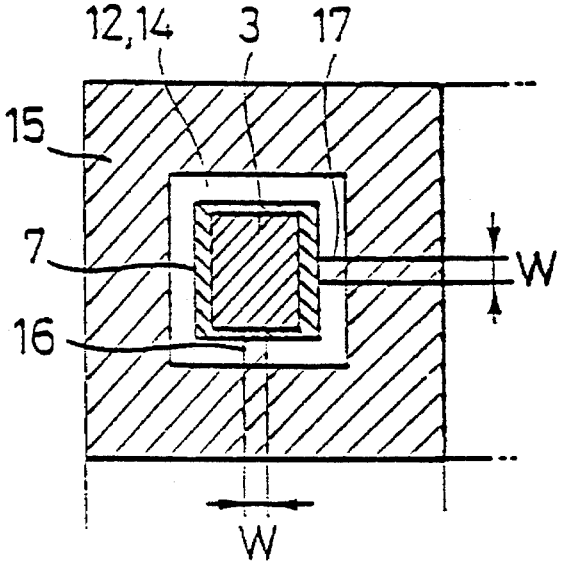
FIG. 16B
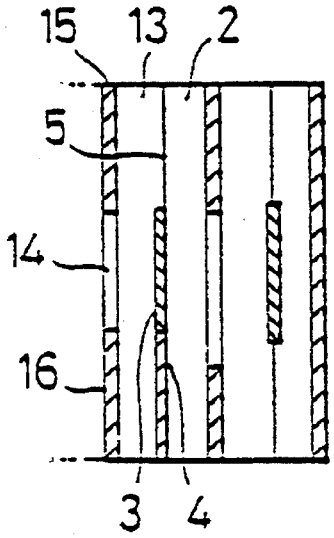
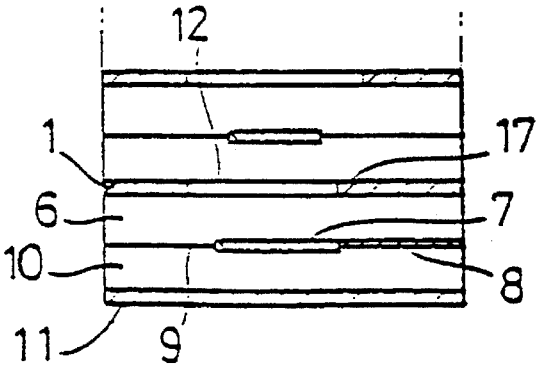
FIG. 16C

DUAL-POLARIZATION PLANAR ANTENNA

This application is a continuation of application Ser. No. 07/977,792, filed Nov. 17, 1992, now abandoned.

BACKGROUND OF THE INVENTION

This invention relates to a dual-polarization planar antenna for use in satellite communication systems and radio communication systems in a microwave band.

In satellite communication systems in a microwave band, it is necessary to switch vertical and horizontal polarizations for every reception channel. Also in radio communication systems, transmission and reception are efficiently carried out by switching vertical and horizontal polarizations or clockwise and counterclockwise circular polarizations. In this connection, development has been made of an antenna operable with controllably variable polarizations.

As a planar antenna of the type described, a microstrip antenna is known. Referring to FIG. 1, the microstrip antenna comprises a ground conductor 1 and a radiation patch element 3 of a square shape. The ground conductor 1 has a slot 12 formed at a position right below the radiation patch element 3. A triplate line is formed by a combination of the ground conductors 1 and 11 and a feeding line 8. The triplate line and the radiation patch element 3 are electromagnetically coupled to each other through the slot 12. A feeding line 4 is connected to one end of the radiation patch element 3. The radiation patch element 3 is excited by the feeding lines 4 and 8 in a first excitation direction A and a second excitation direction B, respectively. The first and the second excitation directions A and B are perpendicular to each other. With this structure, it is possible to use both the vertical and the horizontal polarizations. Such an antenna is disclosed in the paper entitled "Study on Dual-Polarization Planar Antenna" and prepared for the 1990 Springtime National Conference of Electronics, Information, and Communication Society, Japan, Paper No. B-133, and the paper entitled "Radiation Characteristics of Dual-Polarization Planar Array" and prepared for the 1990 Autumnal National Conference of Electronics, Information, and Communication Society, Japan, Paper No. B-93.

The above-mentioned dual-polarization microstrip antenna has a switching circuit for electrically switching the outputs of the feeding lines 4 and 8. Accordingly, when the antenna is operated with the vertical and the horizontal polarizations having polarization planes perpendicular to each other, it is possible to obtain a desired polarization output without mechanical rotation of the antenna itself. In addition, the dual-polarization microstrip antenna can rapidly follow the change of the polarization plane. As a result, interruption of communication is avoided. A mounting structure is simple because a mechanical drive is unnecessary.

In the above-mentioned conventional antenna, the triplate line formed by a combination of the ground conductors 1 and 11 and the feeding line 8 is electromagnetically coupled to the radiation patch element 3 through the slot 12. In this event, a parallel plate mode wave is produced and propagated between the ground conductors 1 and 11 to cause leakage of electric power. This results in occurrence of unnecessary coupling or radiation to thereby deteriorate the characteristic of the antenna. Such phenomenon is described in Proceedings of ICAP89, April, pp. 346–368 (1989), Digest IEEE International Microwave Symposium, pp. 199–202 (1988), A.P91-35 "Analysis and Solution of the Parallel Plate Mode by the Use of the Spatial Circuit Network Method", and other reports in recent conferences.

SUMMARY OF THE INVENTION

It is an object of this invention to provide a dual-polarization planar antenna which has an excellent characteristic without occurrence of unnecessary coupling and radiation due to a parallel plate mode wave.

It is another object of this invention to provide a dual-polarization planar antenna having a gain stability characteristic irrespective of polarization directions as well as a high efficiency characteristic.

It is a further object of this invention to provide a dual-polarization planar antenna which is capable of selecting a direction of a main beam for each of polarized waves to be used.

It is a still further object of this invention to provide a dual-polarization planar antenna having an excellent directivity without suffering deterioration of gain and efficiency characteristics and without increase of a level of an unnecessary side lobe.

In order to accomplish the above-mentioned objects, this invention provides a dual-polarization planar antenna comprising: a first feeding substrate having a plurality of first radiation patch elements and a first feeding line; a first dielectric member; a first ground conductor having a plurality of slots; a second dielectric member; a second feeding substrate having a plurality of second radiation patch elements and a second feeding line; a third dielectric member; and a second ground conductor; wherein the first feeding substrate, the first dielectric member, the first ground conductor, the second dielectric member, the second feeding substrate, the third dielectric member, and the second ground conductor are successively superposed in this order; wherein the first feeding substrate, the first ground conductor, and the second feeding substrate are arranged so that the slots, the first radiation patch elements, and the second radiation patch elements are overlapped with one another; wherein the first and the second feeding substrates are arranged so that the first radiation patch elements are excited by the first feeding line in a first excitation direction while the second radiation patch elements are excited by the second feeding line in a second excitation direction perpendicular to the first excitation direction, whereby both vertical and horizontal polarizations are used.

In a preferred embodiment, each of the first radiation patch elements and/or the second radiation patch elements has different dimensions in an excitation direction and a nonexcitation direction. The sizes of the first and the second radiation patch elements are independently determined in correspondence to polarized waves to be used.

In another preferred embodiment, the first and the second radiation patch elements have excitation phases controlled by the first and the second feeding lines, respectively, so that main beams exhibiting maximum gains for polarized waves to be used are oriented to different directions in correspondence to the polarized waves to be used.

In a further preferred embodiment, each slot of a third ground conductor has a shield portion formed at a position right above the first feeding line while each slot of the first ground conductor has a shield portion formed at a position right above the second feeding line.

BRIEF DESCRIPTION OF THE DRAWING

FIG. 13A, 13B and 13C describe an unnecessary small radiation produced in the dual-polarization planar antenna;

FIG. 16A, 16B and 16C show shield portions in the seventh embodiment;

DESCRIPTION OF THE PREFERRED EMBODIMENTS

First Embodiment

Figure 1:
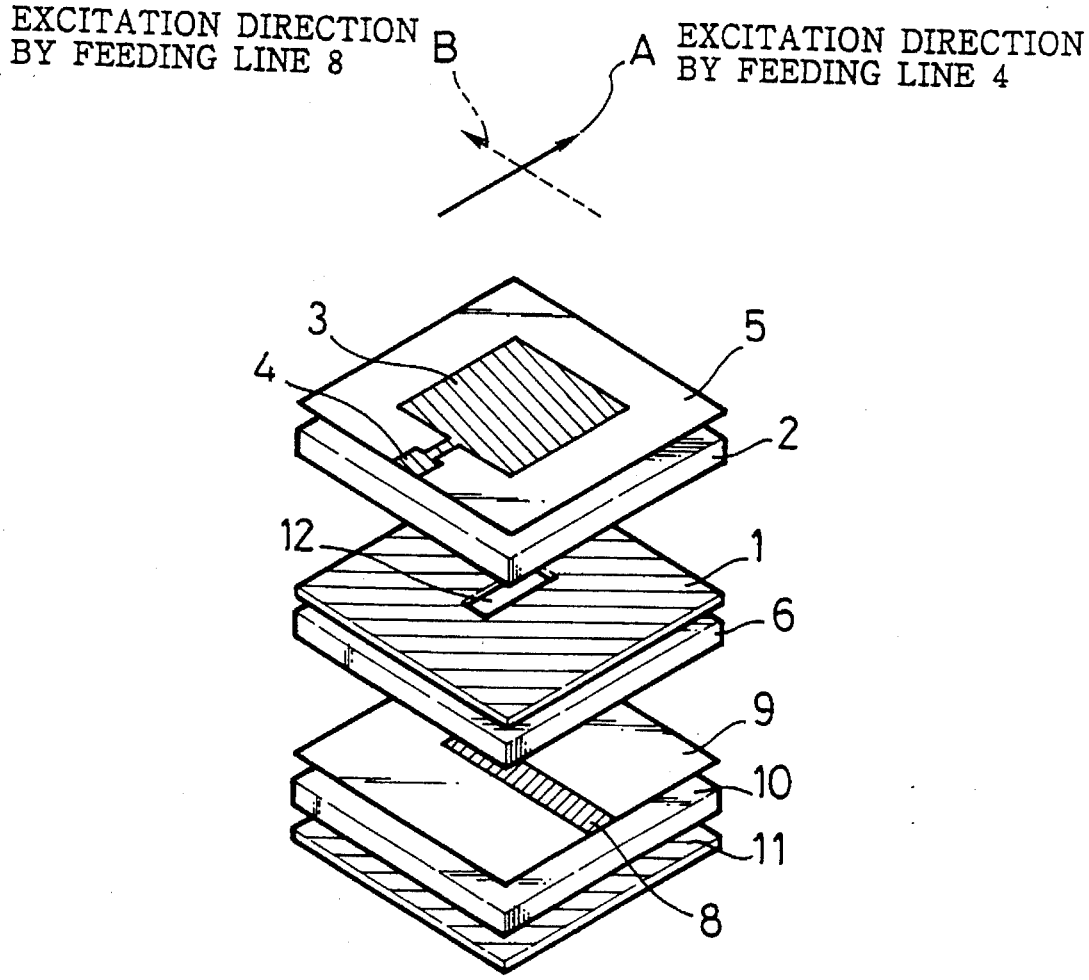
FIG. 1 PRIOR ART
FIG. 1 is an exploded perspective view of a conventional dual-polarization planar antenna.
Figure 2:
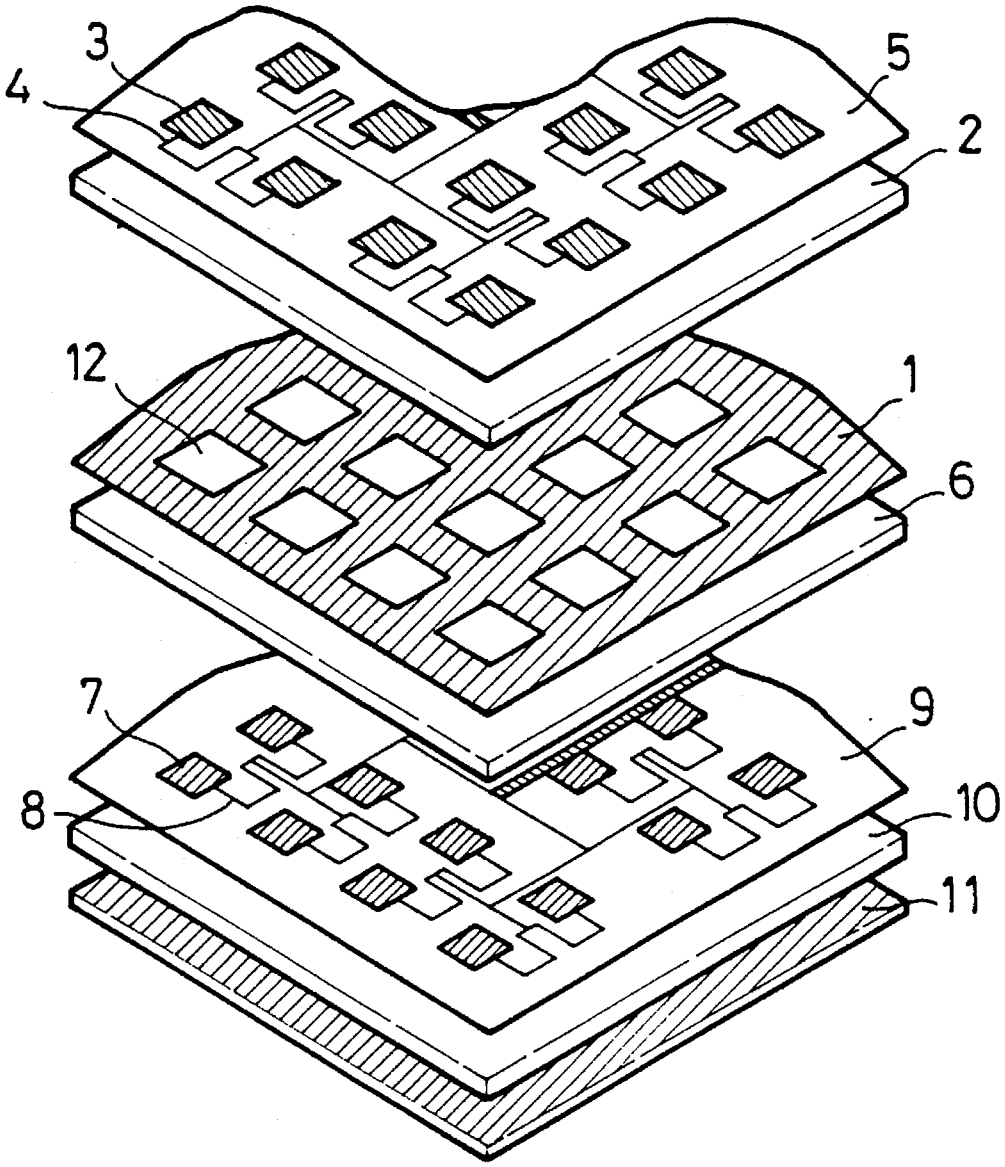
FIG. 2 is an exploded perspective view of a dual-polarization planar antenna according to a first embodiment of this invention.

Referring to FIG. 2, a dual-polarization planar antenna according to a first embodiment of this invention comprises a first feeding substrate 5 provided with a plurality of first radiation patch elements 3 and a first feeding line 4, a first dielectric member 2, a first ground conductor 1 having a plurality of slots 12, a second dielectric member 6, a second feeding substrate 9 provided with a plurality of second radiation patch elements 7 and a second feeding line 8, a third dielectric member 10, and a second ground conductor 11. As illustrated in the figure, these components are successively superposed in this order.

The first feeding substrate 5, the first ground conductor 1, and the second feeding substrate 9 are arranged so that the slots 12, the first radiation patch elements 3, and the second radiation patch elements 7 are positioned at substantially same locations when seen from the above.

The first and the second feeding substrates 5, 9 are arranged so that the first radiation patch elements 3 are excited by the first feeding line 4 in a first excitation direction while the second radiation patch elements 7 are excited by the second feeding line 8 in a second excitation direction perpendicular to the first excitation direction. It is thus possible to use both vertical and horizontal polarizations.

In the first embodiment, the first ground conductor 1 comprises a 90 mm×90 mm aluminum plate having a thickness of 0.5 mm. Likewise, the second ground conductor 11 comprises a 90 mm×90 mm aluminum plate having a thickness of 1 mm. Each of the first, the second, and the third dielectric members 2, 6, and 10 comprises a polyethylene foam plate having a thickness of 2 mm and a relative dielectric constant of 1.1. Each of the first and the second feeding substrates 5 and 9 comprises a PET film having a thickness of 25 μm and a copper laminate having a thickness of 35 μm adhered to the PET film.

The first feeding substrate 5 has an antenna circuit including the first radiation elements 3 and the first feeding line 4. Likewise, the second feeding substrate 9 has an antenna circuit including the second radiation elements 7 and the second feeding line 8. The antenna circuits are formed by etching the copper laminates to remove unnecessary portions. The first ground conductor 1 has the slots 12 of 14 mm square formed at positions right below the first radiation patch elements 3 and right above the second radiation patch elements 7. Each of the first radiation patch elements 3 has a substantially 6.9 mm square shape while each of the second radiation patch elements 7 has a substantially 7.2 mm square shape.

Herein, the number of the first radiation patch elements 3, the number of the second radiation patch elements 7, and the number of the slots 12 are all equal to sixteen. The first radiation patch elements 3, the second radiation patch elements 7, and the slots 12 are equidistantly arranged in two directions perpendicular to each other. The distance in these two directions is selected to be 21.7 mm which is equal to 0.9 time the free space wavelength of 24.1 mm at an operation frequency of 12.45 GHz. The components are successively superposed so that the first and the second feeding lines 4 and 8 are perpendicular to each other. Thus, a 16-element array antenna is formed.

Figure 3:
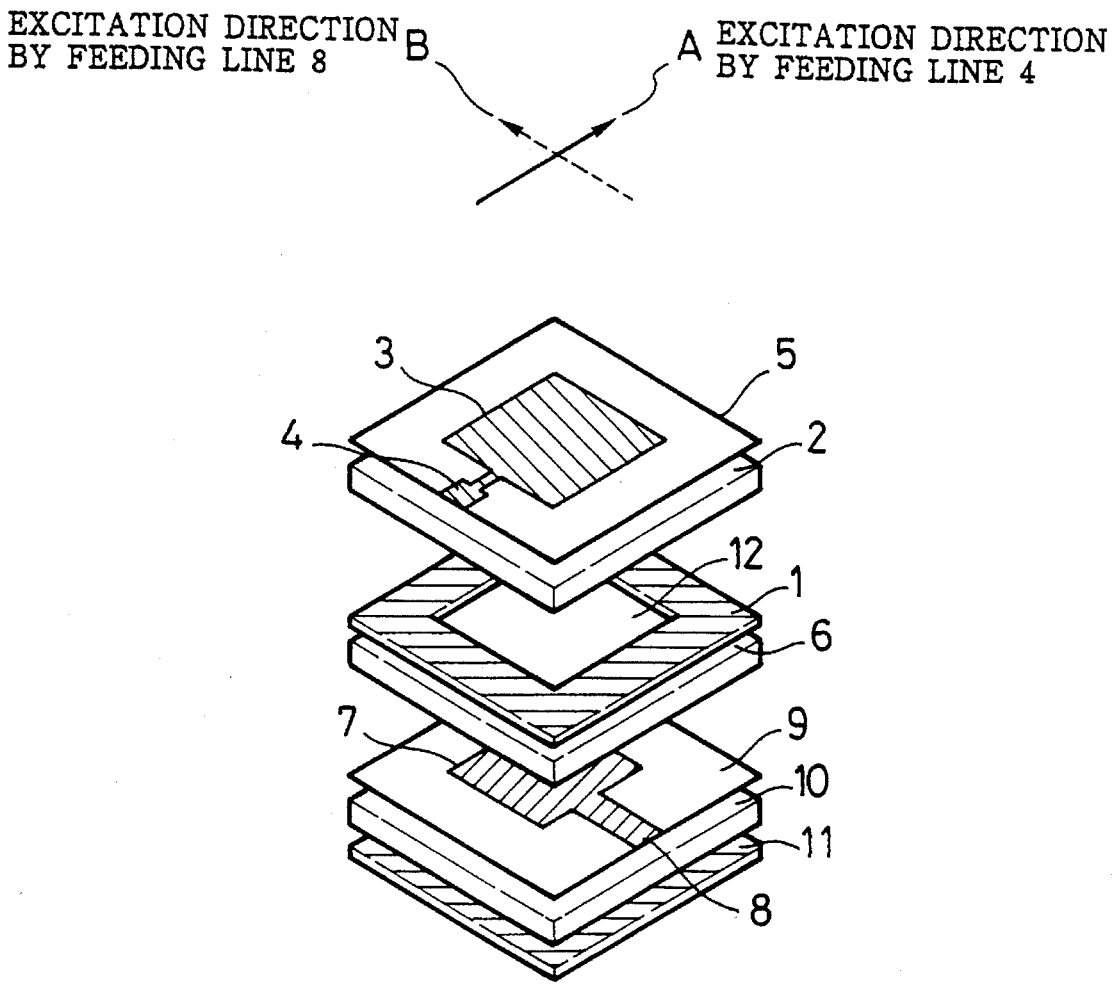
FIG. 3 is an enlarged exploded perspective view of a part of the dual-polarization planar antenna illustrated in FIG. 2.

This antenna has a gain of 18.2 dB for linear polarization excited by the first feeding line 4 in a first excitation direction (the direction A in FIG. 3). On the other hand, the antenna has a gain of 20.0 dB for linear polarization excited by the second feeding line 8 in a second excitation direction (the direction B in FIG. 3).

In the dual-polarization planar antenna according to this embodiment, each of the second radiation patch elements 7 is connected to a terminal end of the second feeding line 8 as illustrated in FIG. 3. A pair of the first and the second radiation patch elements 3 and 7 are electromagnetically coupled to each other through each slot 12. The slots 12 serve as apertures for electromagnetically coupling the first and the second radiation patch elements 3 and 7.

The present inventors have studied a planar antenna of a triplate feeding type comprising a structure from the first ground conductor 1 to the second ground conductor 11 with the slot apertures formed above the radiation patch elements as illustrated in FIG. 3. They reached the result that a parallel plate mode wave can be effectively utilized by adjustment of the mutual distance in the array of the radiation patch elements.

Taking the above into consideration, the dual-polarization planar antenna according to this embodiment has a structure capable of radiating the polarized waves of two different directions. The dual-polarization planar antenna has an excellent characteristic without occurrence of unnecessary coupling or radiation due to the parallel plate mode wave.

Second Embodiment

Figure 4:
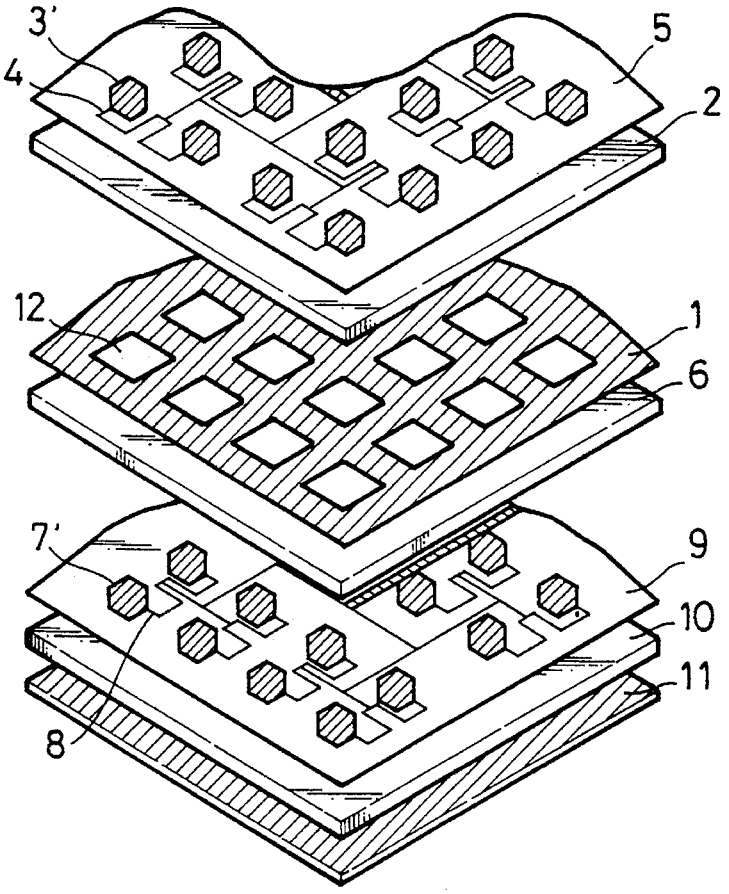
FIG. 4 is an exploded perspective view of a dual-polarization planar antenna according to a second embodiment of this invention.

Referring to FIG. 4, a dual-polarization planar antenna according to a second embodiment of this invention comprises a first feeding substrate 5 provided with first radiation patch elements 3' for radiating a plurality of circularly polarized waves and a first feeding line 4, a first dielectric member 2, a first ground conductor 1 having a plurality of slots 12, a second dielectric member 6, a second feeding substrate 9 provided with second radiation patch elements 7' for radiating a plurality of circularly polarized waves and a second feeding line 8, a third dielectric member 10, and a second ground conductor 11. These components are successively superposed in this order, as illustrated in the figure.

The first feeding substrate 5, the first ground conductor 1, and the second feeding substrate 9 are arranged so that the slots 12, the first radiation patch elements 3', and the second radiation patch elements 7' are positioned at substantially same locations when seen from the above.

The first and the second feeding substrates 5 and 9 are arranged so that the first and the second radiation patch elements 3' and 7' have different rotational directions. It is thus possible to use both clockwise and counterclockwise polarizations.

The first and the second radiation patch elements 3' and 7' in the second embodiment have a shape such that corners of the first and the second radiation patch elements 3 and 7 in the first embodiment are cut off. In this connection, the first and the second radiation patch elements 3' and 7' can radiate the circularly polarized waves having rotational directions different from each other. Herein, a cut-off area of each of the first and the second radiation patch elements 3∝ and 7' corresponds to 14% of the area of each of the first and the second radiation patch elements 3 and 7.

In this case, gains for the clockwise and the counterclockwise circular polarizations excited by the first and the second feeding lines 4 and 8 are similar to those of the gains for the linear polarizations obtained in the first embodiment, respectively.

According to the second embodiment, it is possible to use both the clockwise and the counterclockwise polarizations. As a result, this antenna has a circular polarization characteristic which is excellent in an axial ratio and a VSWR (voltage to standing-wave ratio) characteristic over a wide band.

Third Embodiment

Figure 5:
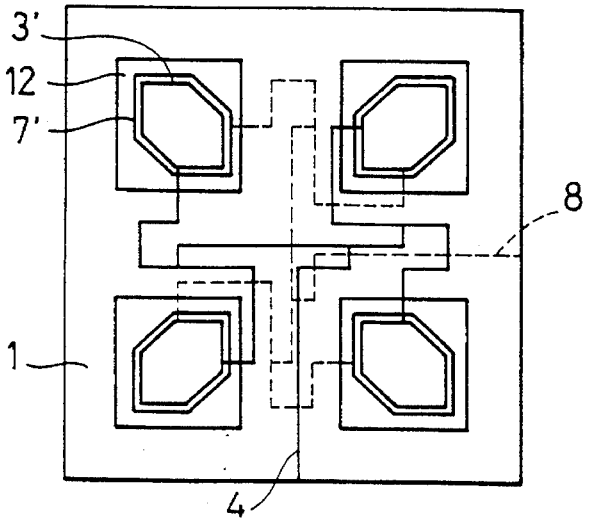
FIG. 5 is a plan view for describing an arrangement of first and second radiation patch elements in a dual-polarization planar antenna according to a third embodiment of this invention.

A dual-polarization planar antenna according to a third embodiment of this invention has a basic structure substantially similar to that of the second embodiment illustrated in FIG. 4. In the third embodiment illustrated in FIG. 5, the first and the second radiation patch elements 3' and 7' are arranged so that two adjacent ones of the radiation patch elements 3' and 7' are rotated by 90° from each other. The two adjacent ones of the first and the second radiation patch elements 3' and 7' are controlled to produce the outputs in the same phase.

According to this embodiment, the antenna exhibits an excellent axial ratio. A frequency band having VSWR not greater than 1.3 is as wide as substantially twice the second embodiment.

Fourth Embodiment

Figure 6:
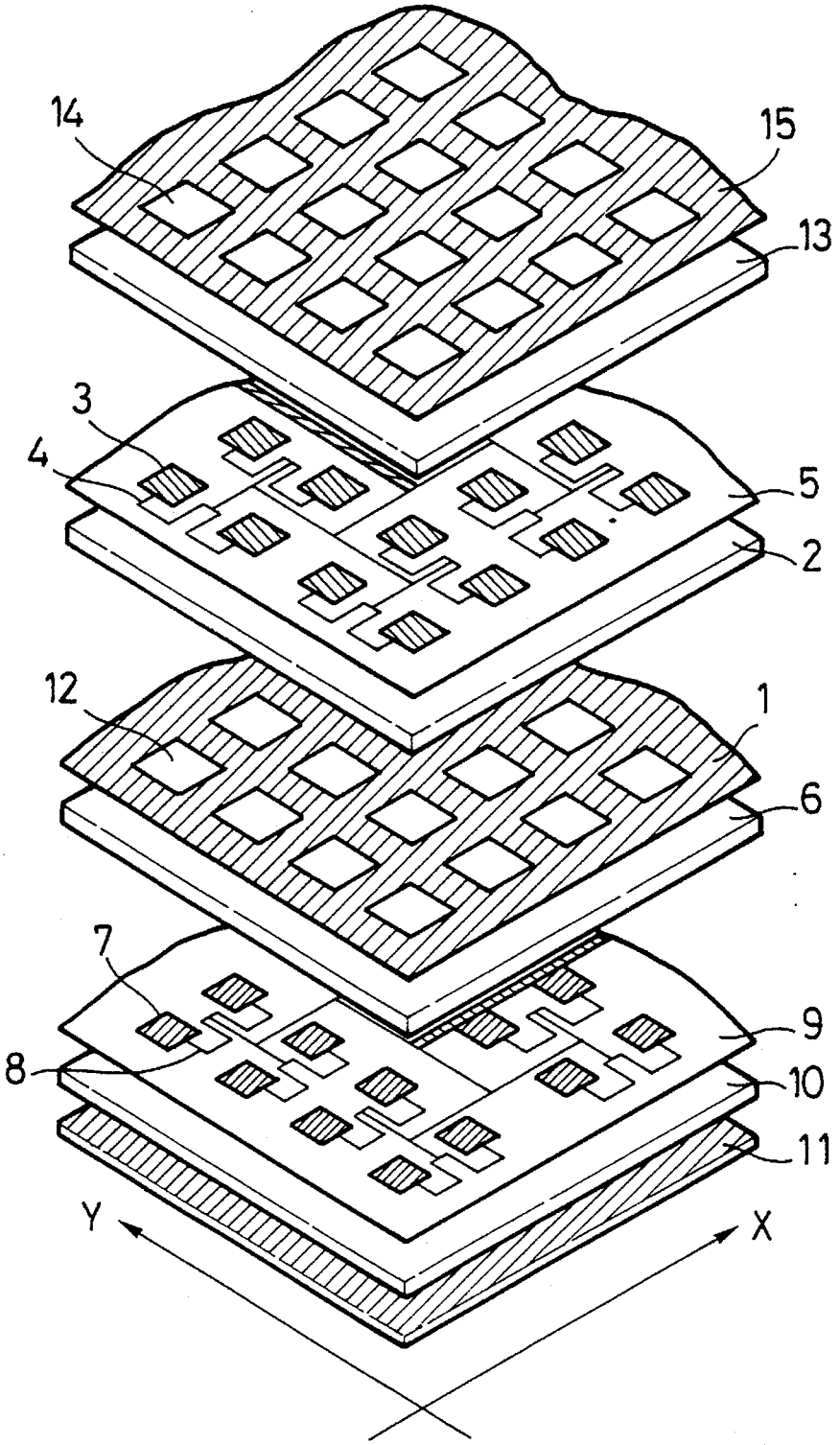
FIG. 6 is an exploded perspective view of a dual-polarization planar antenna according to a fourth embodiment of this invention.

Referring to FIG. 6, a fourth embodiment further comprises a fourth dielectric member 13 and a third ground conductor 15 having a plurality of slots 14, in addition to the structure described in conjunction with the first or the second embodiment. These additional components are superposed on the first feeding substrate 5.

The third ground conductor 15 is arranged so that the first radiation patch elements 3 or 3', the second radiation patch elements 7 or 7', and the slots 14 are positioned at substantially same locations when seen from the above.

In this embodiment, the third ground conductor 15 comprises a 90 mm×90 mm aluminum plate having a thickness of 0.5 mm and has the slots 14 of 14 mm square formed at positions right above the radiation patch elements 3. The fourth dielectric member 13 comprises a polyethylene foam plate having a thickness of 2 mm and a relative dielectric constant of 1.1. The third ground conductor 15 is mounted through the fourth dielectric member 13 on an antenna surface similar to that described in the first through the third embodiments.

In this ease, a gain for polarization excited by the first feeding line 4 is improved by approximately 1.5 through 1.8 dB as compared with the first through the third embodiments. A gain stability characteristic is obtained such that gains for polarizations excited by the first and the second feeding lines 4 and 8 are substantially equal to each other.

According to this embodiment, it is possible to realize a dual-polarization planar antenna which is capable of minimizing an efficiency difference dependent on the directions of reception polarized waves and which therefore has an excellent stability.

In the dual-polarization planar antennas according to the first through the fourth embodiments, the dielectric members 2, 6, 10, and 13 may have different thicknesses.

Fifth Embodiment

Figure 7A:
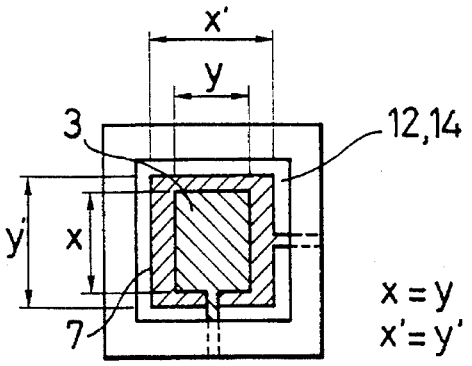
FIG. 7A is a plan view for describing dimensions of first and second radiation patch elements in excitation directions.
Figure 7B:
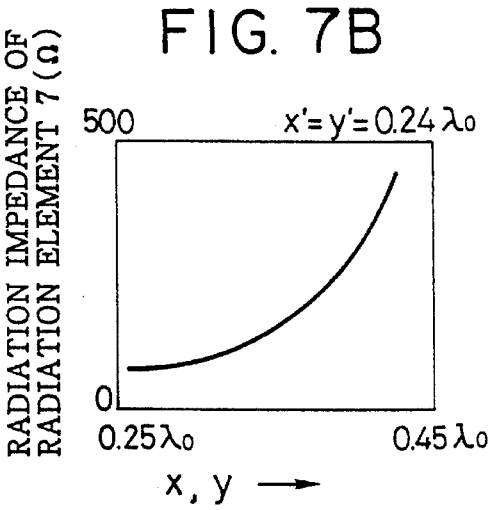
FIG. 7B is a graph for describing a relationship between the dimension of the first radiation patch element in the excitation direction and a radiation impedance of the second radiation patch element.
Figure 7C:
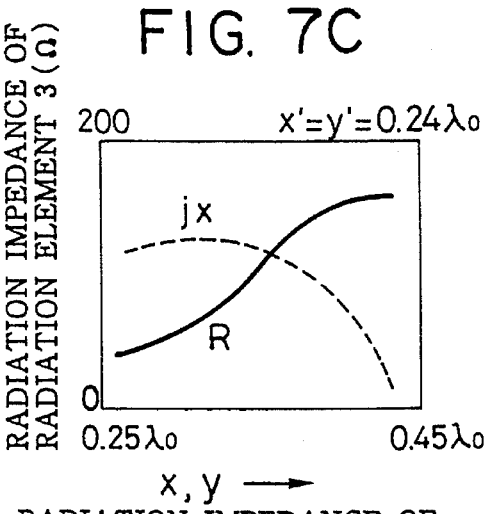
FIG. 7C is a graph for describing a relationship between the dimension of the first radiation patch element in the excitation direction and a teacrance component.
Figure 7D:
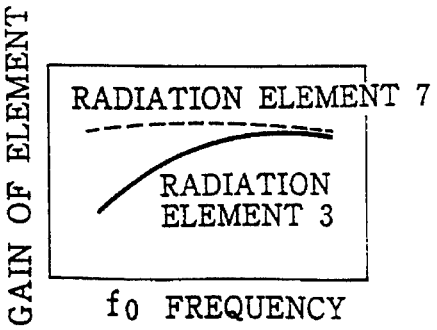
FIG. 7D is a graph for describing a relationship between the gains of the first and the second radiation patch elements when the first radiation patch element has a size smaller than that of the second radiation patch element.
Figure 7E:
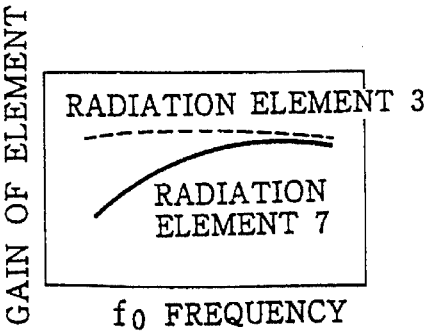
FIG. 7E is a graph for describing a relationship between the gains of the first and the second radiation patch elements when the first radiation element has a size greater than that of the second radiation patch element.

Generally, the antenna illustrated in FIG. 6 is designed to include radiation patch elements of a square or a circular shape. Referring to FIG. 7A, each of the first radiation elements 3 has dimensions x and y in the excitation direction and the nonexcitation direction, respectively. The dimensions x and y are equal to each other. Likewise, each of the second radiation patch elements 7 has dimensions x' and y' in the excitation direction and the nonexcitation direction, respectively. The dimensions x' and y' are equal to each other. As will be understood from FIGS. 7B and 7C, the radiation patch impedance of the second radiation element 7 becomes high with increase of the dimension (x, y) of the first radiation patch element 3. On the other hand, the reactance component of the first radiation patch element 3 becomes large with decrease of the dimension (x, y) of the first radiation patch element 3. This results in difficulty in matching. For example, the first radiation patch element 3 of a smaller size has a gain smaller than that of the second radiation patch element 7, as illustrated in FIG. 7D. On the contrary, if the first radiation patch element 3 has a larger size, a gain of the second radiation patch element 7 is smaller than that of the first radiation patch elements 3, as illustrated in FIG. 7E. Even if the first radiation patch element 3 has an intermediate size, desired conditions could not be obtained for both elements. It is therefore difficult to concurrently achieve a gain stability characteristic and a high efficiency characteristic without presence of a gain difference dependent upon the polarization directions.

According to the fifth embodiment of this invention, the dual-polarization planar antenna has a basic structure similar to that illustrated in FIG. 6. The first and the second radiation patch elements 3 and 7 are electromagnetically coupled to each other. The first radiation patch elements 3 are excited by the first feeding line 4 in the first excitation direction. The second radiation patch elements 7 are excited by the second feeding line 8 in the second excitation direction perpendicular to the first excitation direction. Each of the first radiation patch elements 3 has dimensions x and y in the excitation direction and the nonexcitation direction, respectively. Likewise, each of the second radiation patch elements 7 has dimensions x' and y' in the excitation direction and the nonexcitation direction, respectively. In this particular embodiment, the dimensions x and y are different from each other. Alternatively, the dimensions x' and y' are different from each other. As a further alternative, the dimensions x and y are different from each other while the dimensions x' and y' are also different from each other. Thus, the dimensions of the first and the second radiation patch elements 3 and 7 are independently determined in correspondence to the polarized waves to be used. The first and the second radiation patch elements 3 and 7 in this embodiment may be a circular shape instead of a square shape.

In this embodiment, each of the first and the third ground conductors 1 and 15 comprises a 86 mm×86 mm aluminum plate having a thickness of 0.5 mm while the second ground conductor 11 comprises a 86 mm×86 mm aluminum plate having a thickness of 1 mm. Each of the first, the second, the third, and the fourth dielectric members 2, 6, 10, and 13 comprises a polyethylene foam plate having a thickness of 2 mm and a relative dielectric constant of 1.1. Each of the first and the second feeding substrates 5 and 9 comprises a PET film having a thickness of 25 μm and a copper laminate having a thickness of 35 μm adhered to the PET film. The first feeding substrate 5 has an antenna circuit including the first radiation patch elements 3 and the first feeding line 4. Likewise, the second feeding substrate 9 has an antenna circuit including the second radiation patch elements 7 and the second feeding line 8. The antenna circuits are formed by etching the copper laminates to remove unnecessary portions. The first and the third ground conductors 1 and 15 have slots 12 and 14 formed at positions corresponding to the first and the second radiation patch elements 3 and 7 by press working processes.

Figure 8A:
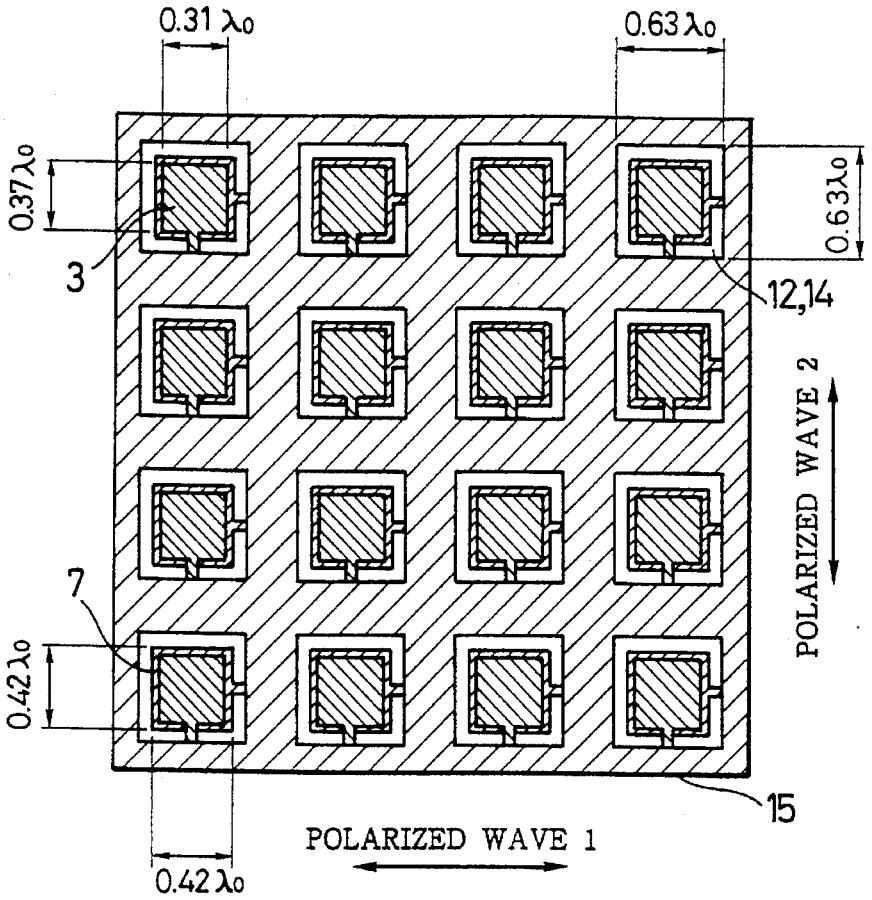
FIG. 8A is a plan view of a dual-polarization planar antenna according to a fifth embodiment of this invention.

In the above-mentioned structure, the number of the first radiation patch elements 3, the number of the second radiation elements 7, and the numbers of the slots 12 and 14 are all equal to sixteen as illustrated in FIG. 8A. These elements and slots are equidistantly arranged in two directions perpendicular to each other. The distance in these two directions is selected to be 21.5 mm which is equal to 0.9 time the free space wavelength $\lambda\Phi$ (=24 mm) at an operation frequency of 12.45 GHz. Each of the first radiation patch elements 3 has dimensions of 0.37 $\lambda\Phi$ and 0.31 $\lambda\Phi$ in the excitation direction and the nonexcitation direction, respectively. Each of the second radiation patch elements 7 has a 0.42 $\lambda\Phi$ square shape. Each of the slots 12 and 14 has a 0.63 $\lambda\Phi$ square shape.

Figure 8B:
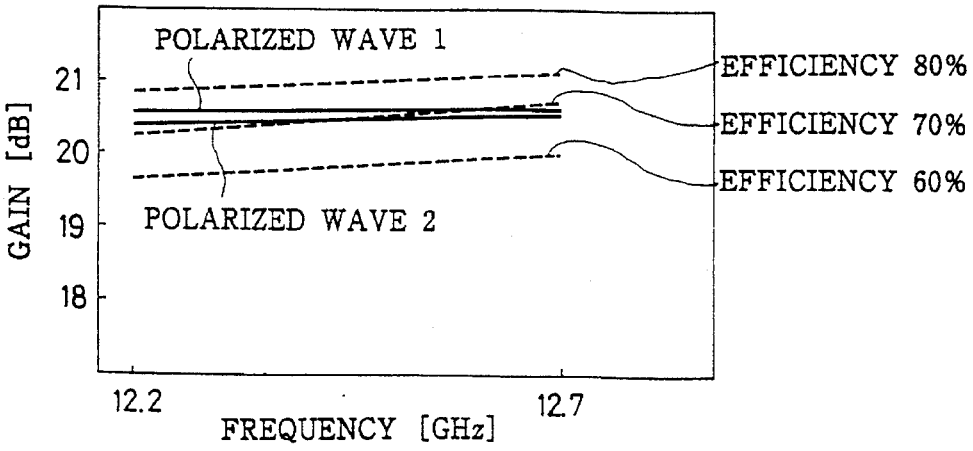
FIG. 8B is a graph showing a characteristic of the dual-polarization planar antenna according to the fifth embodiment of this invention.

The antenna has a reception characteristic as illustrated in FIG. 8B. With respect to polarized waves (1) and (2), a stable characteristic is achieved with an efficiency of approximately 704 at a reception frequency band between 12.2 and 12.7 GHz used in satellite communication in Japan. The polarized waves (1) and (2) have excitation directions indicated in FIG. 8A.

Figure 9A:
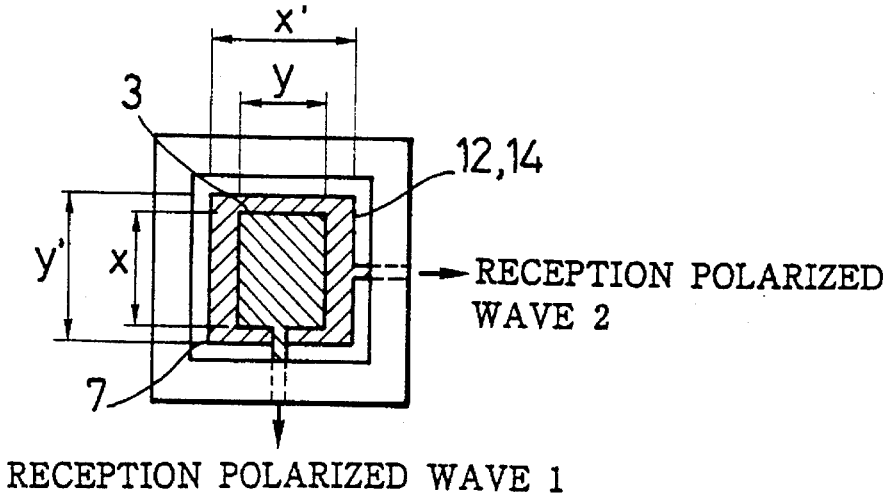
FIG. 9A is an enlarged plan view of a part of the dual-polarization planar antenna according to the fifth embodiment of this invention.
Figure 9B:
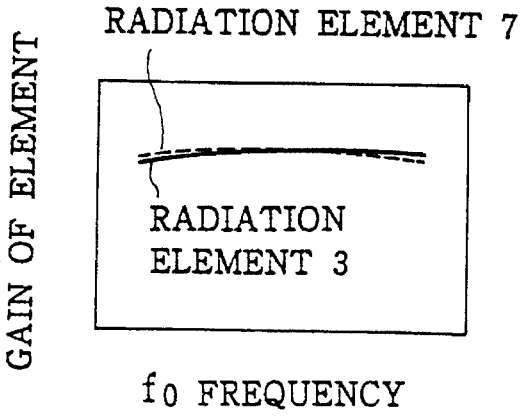
FIG. 9B is a graph showing characteristics of the first and the second radiation patch elements in the fifth embodiment.

As described, each of the first radiation patch elements 3 has the dimensions x and y different from each other, as illustrated in FIG. 9A. Alternatively, each of the second radiation patch elements 7 has the dimensions x' and y' different from each other. As a further alternative, the dimensions x and y are different from each other while the dimensions x' and y' are also different from each other. The dimensions x and y' are independently selected so that the first radiation patch elements 3 for receiving the polarized wave (1) have optimum characteristics. Likewise, the dimensions y and x' are independently selected so that the second radiation patch elements 7 for receiving the polarized wave (2) have optimum characteristics. As shown in FIG. 9B, the dual-polarization planar antenna according to this invention achieves substantially optimum characteristics for both of the first and the second radiation patch elements 3 and 7 without presence of a difference therebetween.

As described above, it is possible according to this invention to provide a dual-polarization planar antenna which is excellent in a gain stability characteristic without presence of a gain difference dependent upon the polarization directions and which achieves a high efficiency.

Sixth Embodiment

Figure 10A:
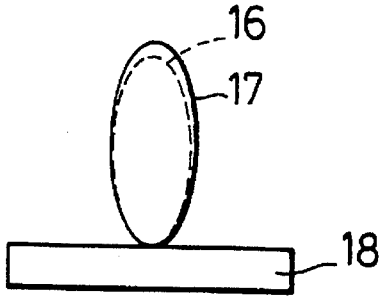
FIG. 10A shows a direction of a main beam in a dual-polarization planar antenna.
Figure 10B:
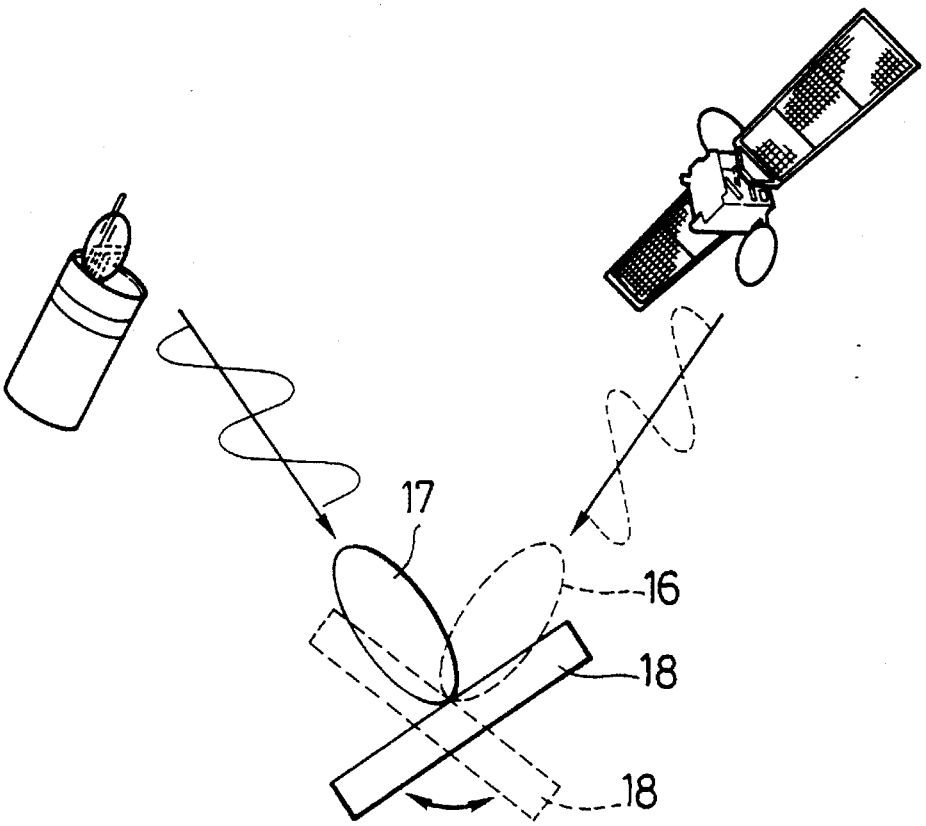
FIG. 10B shows movement of the conventional dual-polarization planar antenna on reception of polarized waves having incoming directions different from one another.

In the known dual-polarization planar antennas of various types, a main beam 16 of a polarization wave A has a direction coincident with that of a main beam 17 of a polarization wave B, as illustrated in FIG. 10A. As shown in FIG. 10B, when an electric wave is transmitted to a dual-polarization planar antenna 18 in the incoming direction (radiation direction) different in dependence upon the polarized wave, the orientation of the dual-polarization planar antenna must be controlled in correspondence to the direction of the reception (transmission) polarized wave.

In view of the above, the sixth embodiment has a structure which allows to select the directions of main beams of the polarized waves to be used.

Specifically, a dual-polarization planar antenna according to the sixth embodiment of this invention has a basic structure similar to that illustrated in FIG. 6. The excitation phases of the first and the second radiation elements 3 and 7 are controlled by the first and the second feeding lines 4 and 8, respectively, so that the main beams exhibiting maximum gains for the polarized waves to be used are oriented in different directions corresponding to the polarized waves.

Referring to FIG. 6, each of the first and the third ground conductors 1 and 15 comprises a 344 mm×344 mm aluminum plate having a thickness of 0.5 mm. The second ground conductor 11 comprises a 344 mm ×344 mm aluminum plate having a thickness of 1 mm. Each of the first, the second, the third, and the fourth dielectric members 2, 6, 10, and 13 comprises a polyethylene foam plate having a thickness of 2 mm and a relative dielectric constant of 1.1. Each of the first and the second feeding substrates 5 and 9 comprises a PET film having a thickness of 25 m and a copper laminate having a thickness of 35 μm adhered to the PET film. The first feeding substrate 5 has an antenna circuit including the first radiation patch elements 3 and the first feeding line 4. Likewise, the second feeding substrate 9 has an antenna circuit including the second radiation patch elements 7 and the second feeding line 8. The antenna circuits are formed by etching the copper laminates to remove unnecessary portions. The first and the third ground conductors 1 and 15 have slots 12 and 14 formed at positions corresponding to the first and the second radiation patch elements 3 and 7 by press working processes. Each of arrays of the first radiation patch elements 3, the second radiation patch elements 7, the slots 12, and the slots 14 comprises 256 elements arranged in sixteen rows and sixteen columns. The mutual distance in the array is selected to be 21.5 mm which is equal to 0.9 time the free space wavelength $\lambda\Phi$ (= 24 mm) at an operation frequency of 12.45 GHz. Furthermore, the first feeding line 4 is adjusted so that the excitation phases of the first radiation patch elements 3 are successively shifted by a lag of 30° towards the direction X depicted in FIG. 6. On the other hand, the second feeding line 8 is adjusted so that the excitation phases of the second radiation elements 7 are successively shifted by a lead of 30° towards the direction X. The above-mentioned antenna has a stable characteristic with an efficiency of approximately 70% achieved for both of the polarized waves in a reception frequency band between 12.2 and 12.7 GHz used in CS (communication satellite) broadcasting in Japan. The main beam of the polarized wave excited by the first feeding line 4 stands up from the antenna surface in a direction inclined at approximately 5° towards the direction X with respect to a vertical direction. The main beam of the polarized wave excited by the second feeding line 8 has a direction inclined at approximately 5° towards a direction opposite to the direction X. Thus, the dual-beam characteristic is obtained such that the main beams of the polarized waves form an angle of approximately 10°.

Figure 11A:
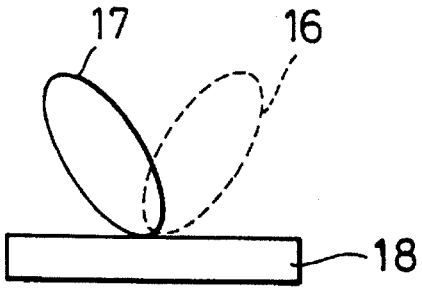
FIG. 11A shows a dual-polarization planar antenna according to a sixth embodiment of this invention with main beams of polarized waves oriented in different directions.
Figure 11B:
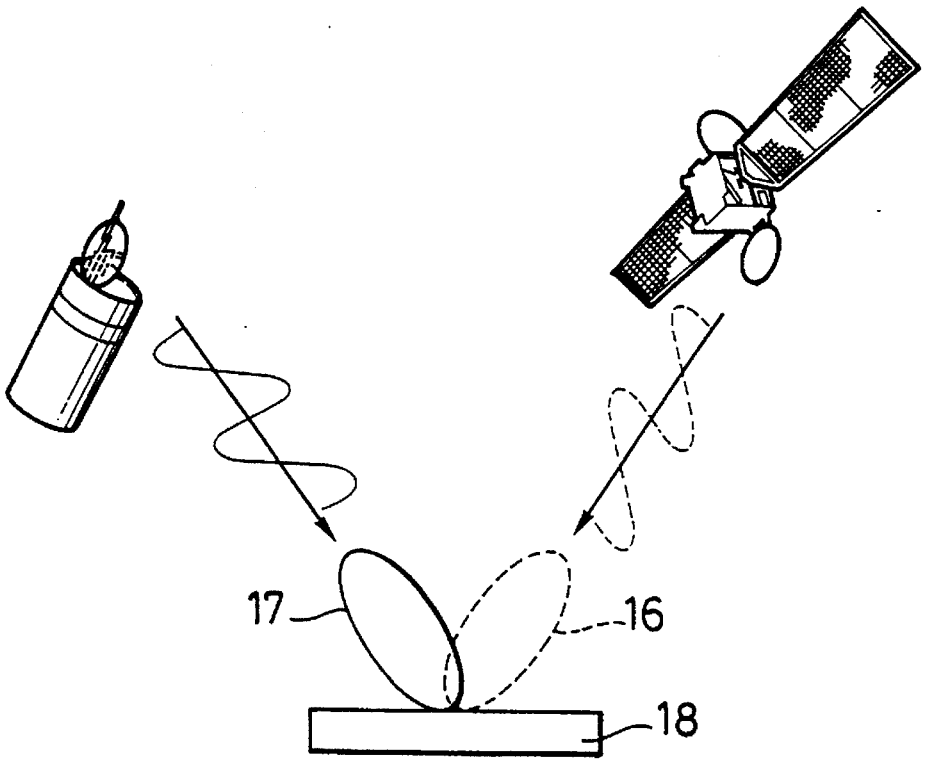
FIG. 11B shows the dual-polarization planar antenna according to the sixth embodiment of this invention on reception of polarized waves having incoming directions different from one another.
Figure 12:
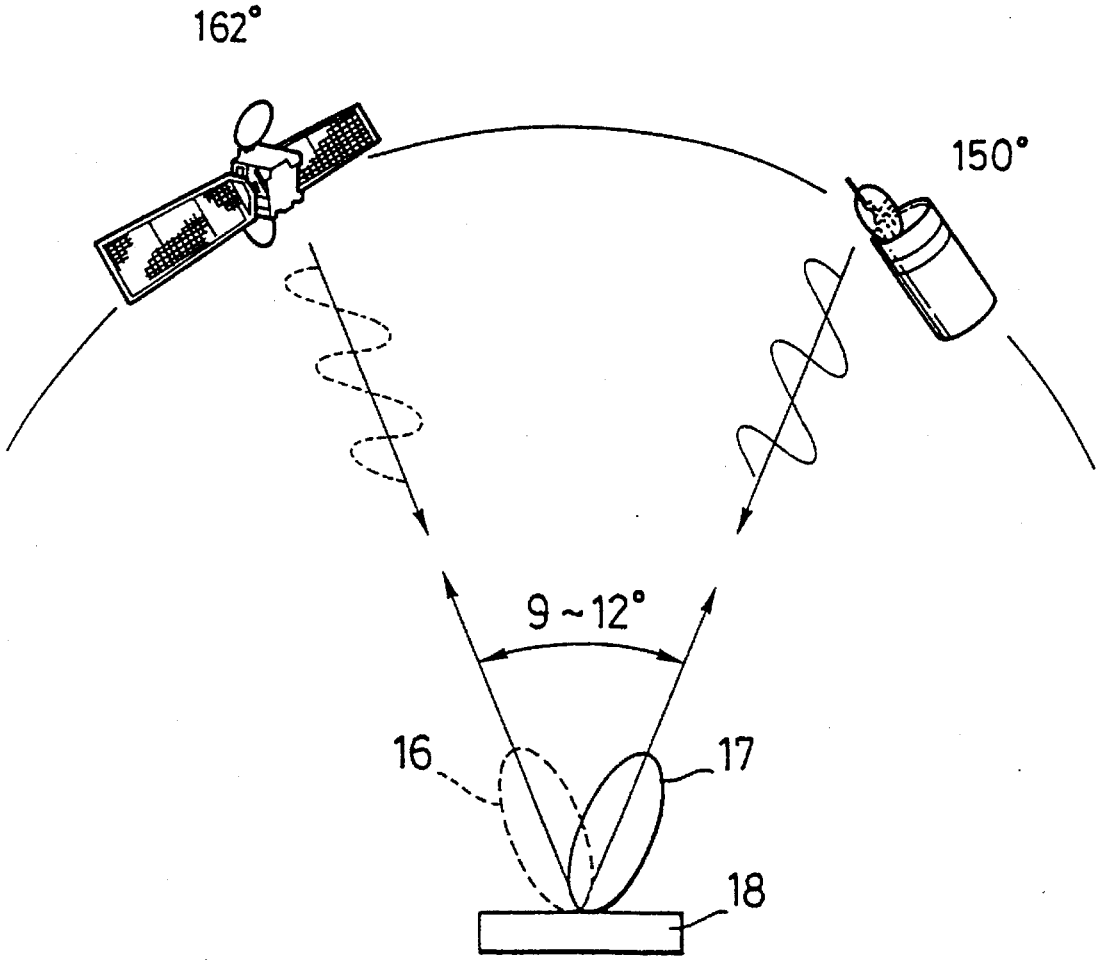
FIG. 12 shows the dual-polarization planar antenna according to the sixth embodiment of this invention when used in receiving a PCM music broadcast through a communication satellite.

The dual-polarization dual-beam planar antenna 18 according to this embodiment is operable with at least two types of the polarized waves and is capable of orienting the main beams 16 and 17 of the polarized waves A and B in different directions as shown in FIG. 11A. When an electric wave is transmitted to the dual-polarization planar antenna 18 in the incoming direction (radiation direction) different in dependence upon the polarized wave as shown in FIG. 11B, it is possible to use the dual-polarization planar antenna 18 in a fixed state without mechanically adjusting the orientation of the antenna in correspondence to the reception (transmission) polarized wave.

With respect to the PCM music broadcast through a communication satellite carried out in Japan, it is preferable that the polarized waves A and B to be used are horizontal and vertical linear polarizations and that the main beams 16 and 17 of the polarized waves A and B are inclined from each other at an angle between 9 and 12 degrees.

When the angle formed by the main beams of the polarized waves is selected between 9 and 12 degrees, it is possible to enjoy services through SUPERBIRD B and JCSAT-2 in the PCM music broadcast anywhere in Japan by the use of a fixed antenna.

According to this embodiment, a dual-polarization characteristic is achieved with a very small difference in reception efficiencies of the polarized waves and with a high efficiency. It is readily possible to obtain a dual-beam characteristic when the excitation phases of the radiation patch elements are changed by controlling the feeding lines.

Seventh Embodiment

Figure 14A:
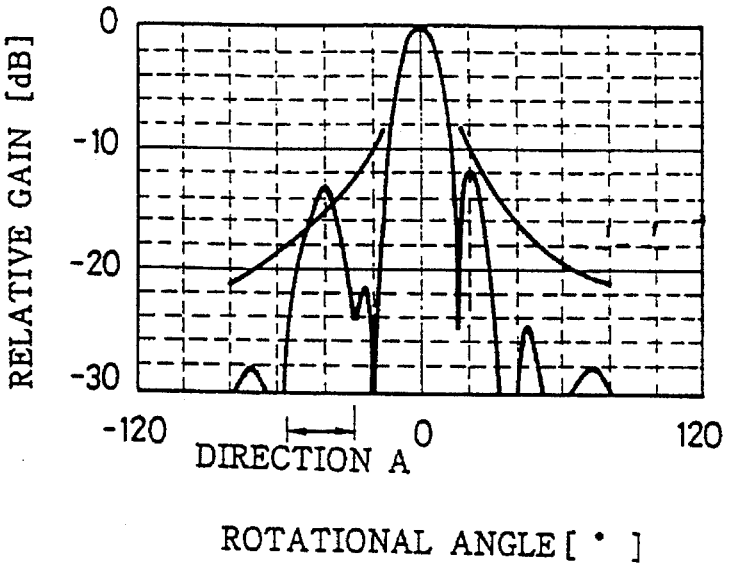
FIGS. 14A and 14B are graphs showing E-plane directivities of polarized waves radiated from lower and upper patches, respectively.
Figure 14B:
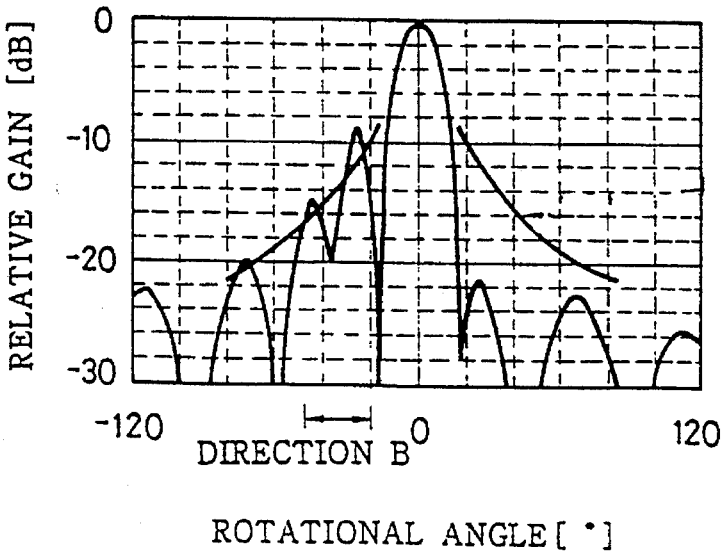

Attention will be directed to a radiation operation performed by a single antenna element in the antenna having the structure illustrated in FIG. 6. Referring to FIG. 13, the second feeding line 8 exposed in the lower slot 12 produces a small unnecessary radiation directed in the direction A and having a polarization similar to the excited polarization radiated from a lower patch. Likewise, the first feeding line 4 exposed in the upper slot 14 produces a small unnecessary radiation directed in the direction B and having a polarization similar to the excited polarization radiated from an upper patch. These unnecessary radiations from the feeding lines are too small to affect the gain. Accordingly, the array antenna illustrated in FIG. 6 realizes high gain and high efficiency characteristics. However, as regards the directivity, the unnecessary radiations from the feeding lines are combined in each of the directions A and B. In the E-plane directivities (directivity in a plane including feeding lines) for the excited polarizations from the upper and the lower patches of the array antenna, a side lobe level increases in each of the directions A and B as shown in FIGS. 14A and 14B. It is thus impossible to realize a desired side lobe level.

In view of the above, the seventh embodiment has a structure such that an excellent directivity is achieved without deterioration of gain and efficiency characteristics and without increase of a level of an unnecessary side lobe.

Figure 15:
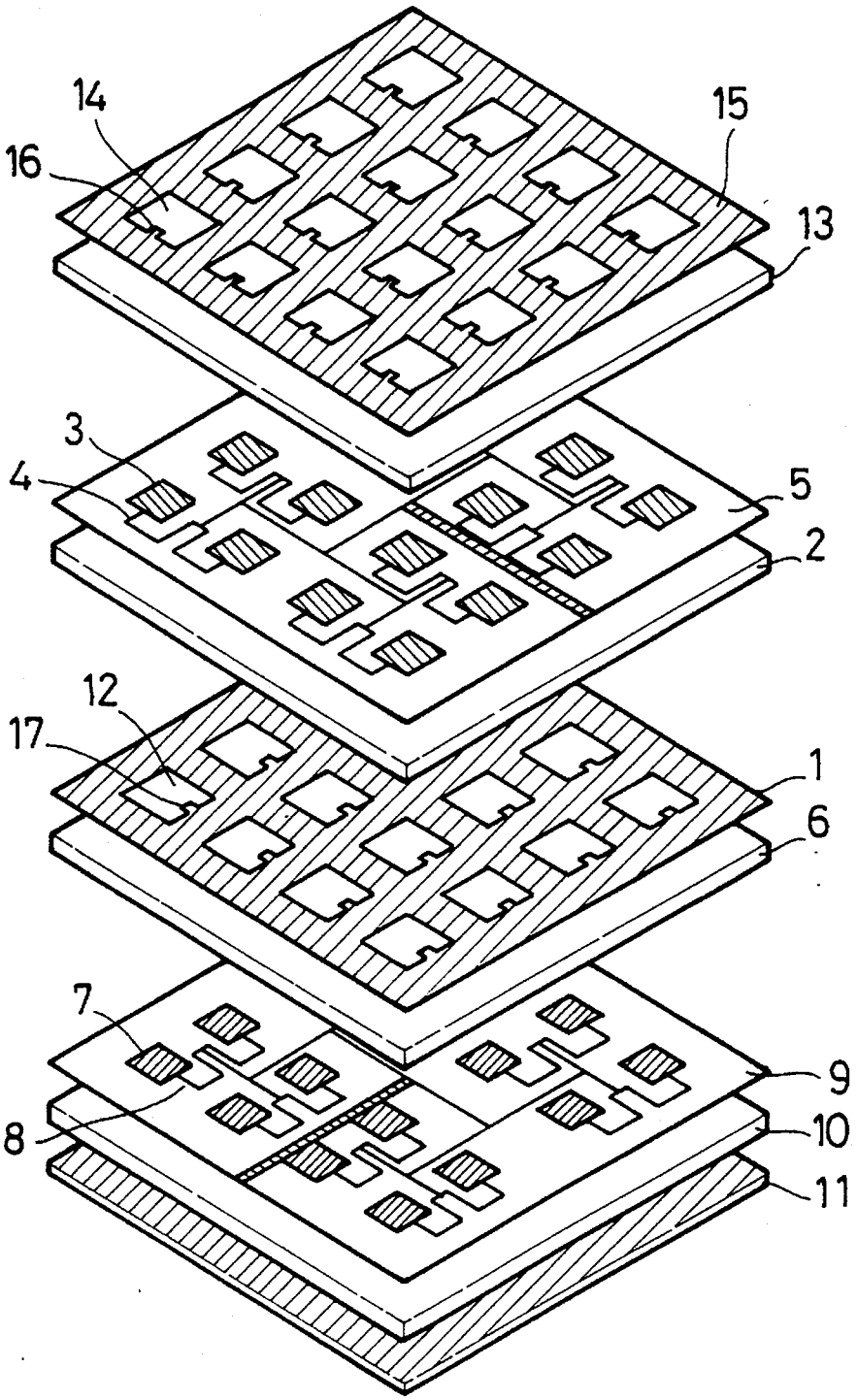
FIG. 15 is an exploded perspective view of a dual-polarization planar antenna according to a seventh embodiment of this invention.

Referring to FIG. 15, the seventh embodiment has a basic structure similar to that illustrated in FIG. 6. The seventh embodiment further comprises a ground conductor shield portion 16 formed in the slot 14 at a position right above the feeding line 4, and a ground conductor shield portion 17 formed in the slot 12 at a position right above the feeding line 8.

As illustrated in FIG. 16, each of the shield portions 16 and 17 has a width W. The width W is preferably equal to or greater than a line width of the feeding line at a line/element junction but not greater than twice the line width. It is desirable that the width W is smaller than 0.13 time the free space wavelength λΦ of the central operation frequency. The widths of the shield portions 16 and 17 may be different from each other. Preferably, each shield portion has an end aligned with the end of the radiation element. However, fringing (spread of the electric field) occurs at the end of the shield portion. In this connection, the end of the shield portion may be shifted within a range of ΔL=0.44 d (d being a thickness of the dielectric members 2, 6, 10, and 13) forwardly or backwardly from the position right above the end of the radiation element.

In this embodiment illustrated in FIG. 15, each of the first and the third ground conductors 1 and 15 comprises a 86 mm ×86 mm aluminum plate having a thickness of 0.5 mm. The second ground conductor 11 comprises a 86 mm×86mm aluminum plate having a thickness of 1 mm. Each of the dielectric members 2, 6, 10, and 13 comprises a polyethylene foam plate having a thickness of 2 mm and a relative dielectric constant of 1.1. Each of the first and the second feeding substrates 5 and 9 comprises a PET film having a thickness of 25 μm and a copper laminate having a thickness of 35 μm adhered to the PET film. The first feeding substrate 5 has an antenna circuit including the first radiation elements 3 and the first feeding line 4. Likewise, the second feeding substrate 9 has an antenna circuit including the second radiation elements 7 and the second feeding line 8. The antenna circuits are formed by etching the copper laminates to remove unnecessary portions. The first and the third ground conductors 1 and 15 have slots 2 and 14 formed by press working processes.

Figure 17A:
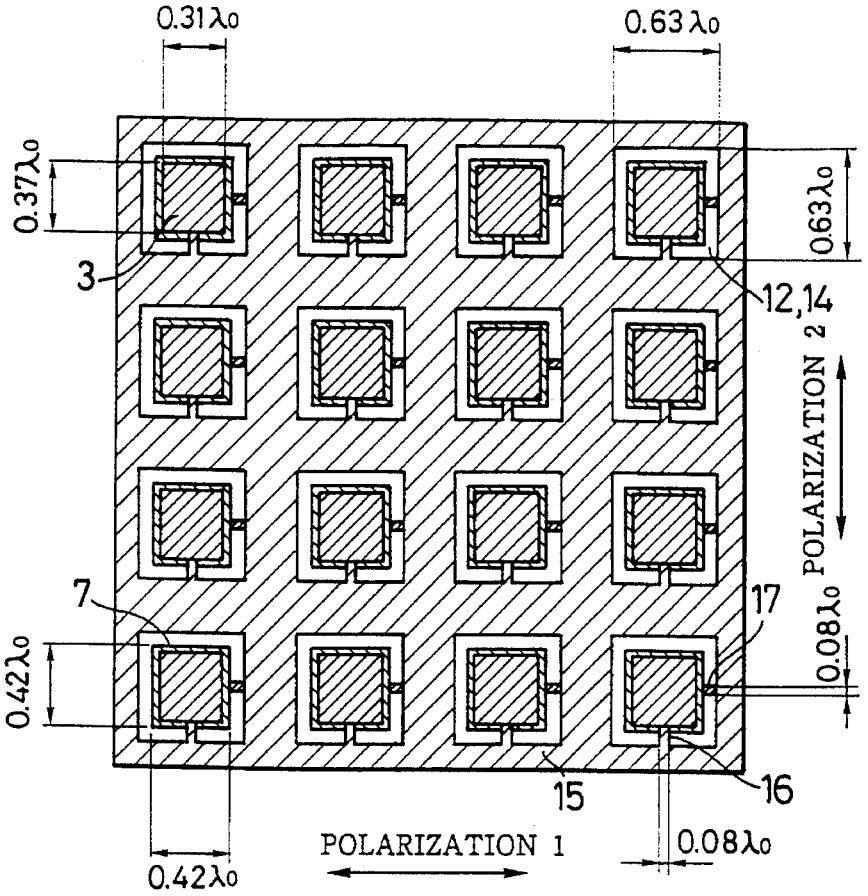
FIG. 17A is a plan view of the dual-polarization planar antenna according to the seventh embodiment of this invention.

With the above-mentioned structure, as shown in FIG. 17A, each of the arrays of the first radiation patch element 3, the second radiation patch element 7, the slot 12, and the slot 14 comprises sixteen elements equidistantly arranged in two directions perpendicular to each other. The distance in these two directions are selected to be 21.5 mm which is approximately equal to 0.9 time the free space wavelength λΦ (=24 mm) at an operation frequency of 12.45 GHz. Each of the first radiation patch elements 3 has dimensions of 0.37 λΦ and 0.31 λΦ in the excitation direction and the nonexcitation direction, respectively. Each of the radiation patch elements 7 has a 0.42 ΞΦ square shape. Each of the slots 12 and 14 has a 0.63 λΦ square shape. Each of the shield portions 16 and 17 has a width of 0.08 λΦ. The end of each shield portion 16 is aligned with the end of the corresponding first radiation element 3. The end of each shield portion 17 is aligned with the end of the corresponding second radiation patch element 7.

Figure 17B:
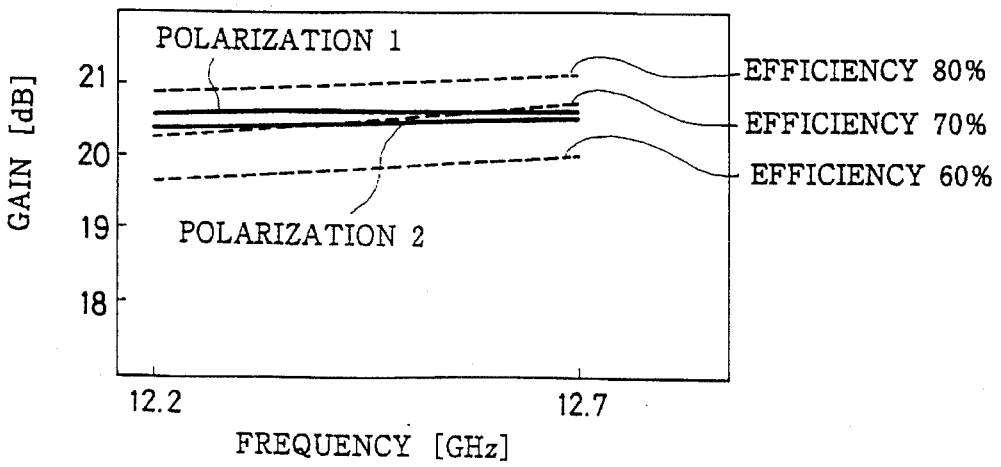
FIG. 17B is a graph showing a reception characteristic of the dual-polarization planar antenna according to the seventh embodiment of this invention.

The antenna has a reception characteristic shown in FIG. 17B. The characteristic is substantially similar to that of the conventional antenna of a similar design except that the shield portions 16 and 17 are not provided.

Figure 18A:
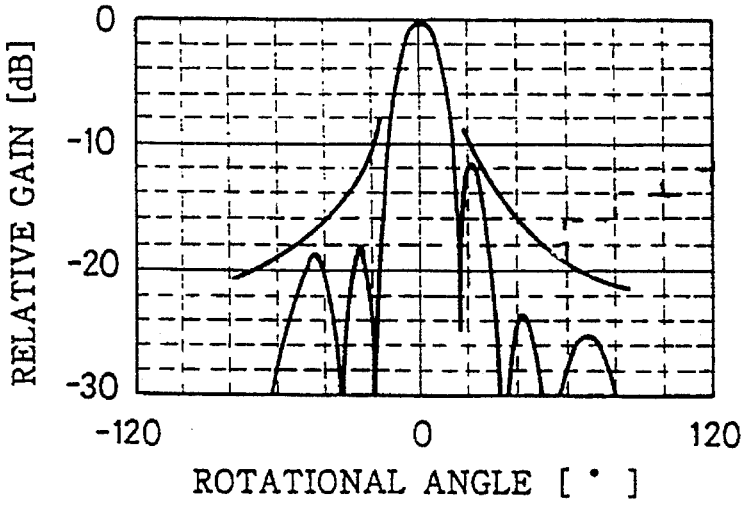
FIGS. 18A and 18B are graphs showing E-plane directivities of polarized waves radiated from lower and upper patches, respectively in the seventh embodiment.
Figure 18B:
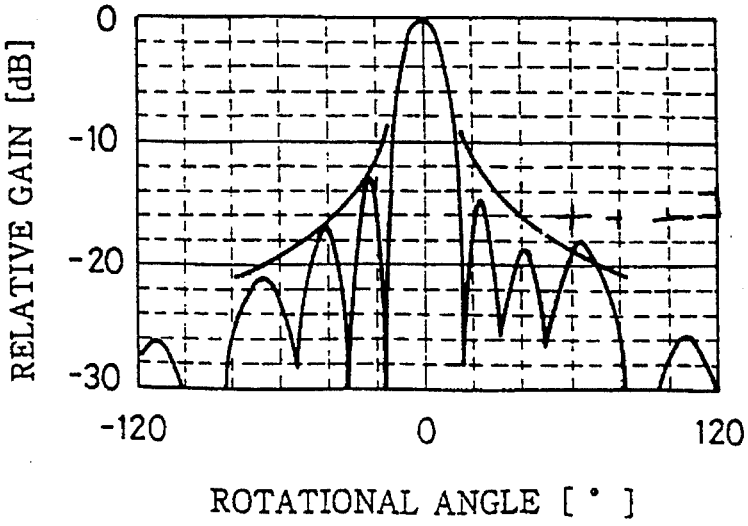

FIGS. 18A and 18B show the E-plane directivities of the excited polarization (polarized wave (1)) from the lower patches and the excited polarization (polarized wave (2)) from the upper patches in the antenna according to this embodiment. Each element is fed with electric power in the same amplitude. As illustrated in the figure, the side lobe level is realized which is equal to or lower than the theoretical side lobe level. FIGS. 14A and 14B show the characteristics of the conventional antenna of a similar design except that the shield portions 16 and 17 are not provided. As compared with the conventional antenna, it will be understood that the antenna according to this embodiment has an excellent directivity without increase of the side lobe level in a particular direction.

In this embodiment, it is possible to suppress the unnecessary radiations produced at junctions between the first radiation patch elements 3 and the first feeding line 4 and between the first radiation patch elements 7 and the second feeding line 8. Accordingly, the increase of the side lobe level in a particular direction is avoided which the conventional antenna suffers. The side lobe level in directivity of the array antenna is rendered equal or smaller than the theoretical side lobe level calculated by combination of the radiation powers from the radiation patch elements.

As described, according to this embodiment, it is readily possible to achieve a desired side lobe characteristic without causing a communication failure because an excellent directivity is realized without deterioration of the high gain and high efficiency characteristics and without increase of the side lobe level in a particular direction.

What is claimed is:

1. A dual-polarization planar antenna comprising:

a first feeding substrate having a plurality of first radiation patch elements and a first feeding line, wherein each of said first radiation patch elements comprises a width dimension which is substantially greater than a width dimension of said first feeding line;

a first dielectric member;

a first ground conductor having a plurality of slots which correspond in position to said plurality of first radiation patch elements;

a second dielectric member;

a second feeding substrate having a plurality of second radiation patch elements which correspond in position to said plurality of first radiation patch elements and said plurality of slots, and a second feeding line, wherein each of said second radiation patch elements comprises a width dimension which is substantially greater than a width dimension of said second feeding line;

a third dielectric member; and a second ground conductor;

wherein said first feeding substrate, said first dielectric member, said first ground conductor, said second dielectric member, said second feeding substrate, said third dielectric member, and said second ground conductor are successively superposed in a direction from a top to a bottom of said dual-polarization planar antenna;

wherein said first feeding substrate, said first ground conductor, and said second feeding substrate are arranged so that said first radiation patch elements, said slots which correspond and said second radiation patch elements which correspond overlap with one another;

wherein respective pairs of said first and said second radiation patch elements are electromagnetically coupled to one another through said slots which correspond, respectively, each of said respective pairs being defined by one of said first radiation patch elements and one of said second radiation patch elements;

wherein said first and said second feeding substrates are arranged so that said first radiation patch elements are excited by said first feeding line in a first excitation direction while said second radiation patch elements are excited by said second feeding line in a second excitation direction perpendicular to said first excitation direction, whereby both vertical and horizontal polarizations are radiated; and wherein dimensions of each of said first radiation patch elements are substantially equal to one another, dimensions of each of said second radiation patch elements are substantially equal to one another, and said dimensions of each of said first radiation patch elements are different from said dimensions of each of said second radiation patch elements.

2. A dual-polarization planar antenna as claimed in claim 1, further comprising:

a fourth dielectric member; and a third ground conductor having a plurality of slots which correspond in position to said plurality of first radiation elements;

wherein said fourth dielectric member is superposed on and adjacent to said first feeding substrate while said third ground conductor is superposed on and adjacent to said fourth dielectric member;

wherein said third ground conductor is arranged so that said slots which correspond overlap said first radiation elements, said slots of said first ground conductor which correspond, and said second radiation elements which correspond.

3. A dual-polarization planar antenna as claimed in claim 1, wherein said first and said second radiation elements have excitation phases controlled by said first and said second feeding lines, respectively, so that main beams exhibiting maximum gains for polarized waves to be radiated are oriented to different directions in correspondence to said polarized waves to be radiated.

4. A dual-polarization planar antenna as claimed in claim 1, wherein said first and said second radiation elements have excitation phases controlled by said first and said second feeding lines, respectively, so that an angle between 9 and 12 degrees is formed by main beams exhibiting maximum gains for said vertical and said horizontal linear polarizations.

5. A dual-polarization planar antenna as claimed in claim 2, wherein each slot of said third ground conductor has a shield portion formed at a position right above said first feeding line while each slot of said first ground conductor has a shield portion formed at a position right above said second feeding line.

6. A dual-polarization planar antenna as claimed in claim 2, wherein each of said first radiation elements has different dimensions in an excitation direction and a nonexcitation direction, the sizes of said first radiation elements being determined in correspondence to polarized waves to be radiated.

7. A dual-polarization planar antenna as claimed in claim 2, wherein each of said second radiation elements has different dimensions in an excitation direction and a nonexcitation direction, the sizes of said second radiation elements being determined in correspondence to polarized waves to be radiated.

8. A dual-polarization planar antenna as claimed in claim 2, wherein each of said first radiation elements and said second radiation elements has different dimensions in an excitation direction and a nonexcitation direction, the sizes of said first radiation elements and said second radiation elements being determined independently of one another in correspondence to polarized waves to be radiated.

9. A dual-polarization planar antenna as claimed in claim 2, wherein said first and said second radiation elements have excitation phases controlled by said first and said second feeding lines, respectively, so that main beams exhibiting maximum gains for polarized waves to be radiated are oriented to different directions in correspondence to said polarized waves to be radiated.

10. A dual-polarization planar antenna as claimed in claim 9, wherein said polarized waves to be radiated are vertically and horizontally linearly polarized, wherein an angle between 9 and 12 degrees is formed by main beams exhibiting maximum gains for said vertical and said horizontal linear polarizations.

11. A dual-polarization planar antenna according to claim 1, wherein said width dimension of each of said first radiation patch elements is at least twice said width dimension of said first feeding line; and said width dimension of each of said second radiation patch elements is at least twice said width dimension of said second feeding line.

12. A dual-polarization planar antenna according to claim 1, wherein each of said first radiation patch elements further comprises a length dimension, wherein a ratio of said length dimension to said width dimension of each of said first radiation patch elements is no greater than 2:1.

13. A dual-polarization planar antenna according to claim 1, wherein each of said second radiation patch elements further comprises a length dimension, wherein a ratio of said length dimension to said width dimension of each of said second radiation patch elements is no greater than 2:1.

14. A dual-polarization planar antenna comprising:

a first feeding substrate having a plurality of first radiation patch elements for radiating a plurality of circularly polarized waves and a first feeding line, wherein each of said first radiation patch elements comprises a width dimension which is substantially greater than a width dimension of said first feeding line;

a first dielectric member;

a first ground conductor having a plurality of slots which correspond in position to said plurality of first radiation patch elements;

a second dielectric member;

a second feeding substrate having a plurality of second radiation patch elements, which correspond in position to said plurality of first radiation patch elements and said plurality of slots, for radiating a plurality of circularly polarized waves and a second feeding line, wherein each of said second radiation patch elements comprises a width dimension which is substantially greater than a width dimension of said second feeding line;

a third dielectric member; and a second ground conductor;

wherein said first feeding substrate, said first dielectric member, said first ground conductor, said second dielectric member, said second feeding substrate, said third dielectric member, and said second ground conductor are successively superposed in a direction from a top to a bottom of said dual-polarization planar antenna;

wherein said first feeding substrate, said first ground conductor, and said second feeding substrate are arranged so that said first radiation patch elements, said slots which correspond and said second radiation patch elements which correspond overlap with one another;

wherein respective pairs of said first and said second radiation patch elements are electromagnetically coupled to one another through said slots which correspond, respectively, each of said respective pairs being defined by one of said first radiation patch elements and one of said second radiation patch elements;

wherein said first and said second feeding substrates are formed so that said first and second radiation patch elements are oriented for radiating oppositely circularly polarized waves, whereby both clockwise and counterclockwise polarizations are radiated;

wherein dimensions of each of said first radiation patch elements are substantially equal to one another, dimensions of each of said second radiation patch elements are substantially equal to one another, and said dimensions of each of said first radiation patch elements are different from said dimensions of each of said second radiation patch elements.

15. A dual-polarization planar antenna as claimed in claim 14, wherein adjacent elements of said plurality of first radiation elements are rotated by a angle of 90° with respect to one another, and adjacent elements of said plurality of second radiation elements are rotated by an angle of 90° with respect to one another, said first and said second radiation elements being controlled to have the same phase.

16. A dual-polarization planar antenna as claimed in claim 14, wherein each of said first radiation elements has different dimensions in an excitation direction and a nonexcitation direction, the sizes of said first radiation elements being determined in correspondence to polarized waves to be radiated.

17. A dual-polarization planar antenna as claimed in claim 14, further comprising:

a fourth dielectric member; and a third ground conductor having a plurality of slots which correspond in position to said plurality of first radiation elements;

wherein said fourth dielectric member is superposed on and adjacent to said first feeding substrate while said third ground conductor is superposed on and adjacent to said fourth dielectric member;

wherein said third ground conductor is arranged so that said slots of aid third ground conductor which correspond overlap said first radiation elements, said slots of said first ground conductor which correspond, and said second radiation elements which correspond.

18. A dual-polarization planar antenna as claimed in claim 17, wherein each slot of said third ground conductor has a shield portion formed at a position right above said first feeding line while each slot of said first ground conductor has a shield portion formed at a position right above said second feeding line.

19. A dual-polarization planar antenna as claimed in claim 15, further comprising:

a fourth dielectric member; and a third ground conductor having a plurality of slots which correspond in position to said plurality of first radiation elements;

wherein said fourth dielectric member is superposed on and adjacent to said first feeding substrate while said third ground conductor is superposed on and adjacent to said fourth dielectric member;

wherein said third ground conductor is arranged so that said slots which correspond overlap said first radiation elements, said slots of aid first ground conductor which correspond, and said second radiation elements which correspond.

20. A dual-polarization planar antenna as claimed in claim 19, wherein each slot of said third ground conductor has a shield portion formed at a position right above said first feeding line while each slot of said first ground conductor has a shield portion formed at a position right above said second feeding line.

21. A dual-polarization planar antenna as claimed in claim 14, wherein each of said second radiation elements has different dimensions in an excitation direction and a nonexcitation direction, the sizes of said second radiation elements being determined in correspondence to polarized waves to be radiated.

22. A dual-polarization planar antenna as claimed in claim 14, wherein each of said first radiation elements and said second radiation elements has different dimensions in an excitation direction and a nonexcitation direction, the sizes of said first radiation elements and said second radiation elements being determined independently of one another in correspondence to polarized waves to be radiated.

23. A dual-polarization planar antenna according to claim 14, wherein said width dimension of each of said first radiation patch elements is at least twice said width dimension of said first feeding line; and said width dimension of each of said second radiation patch elements is at least twice said width dimension of said second feeding line.

24. A dual-polarization planar antenna according to claim 14, wherein each of said first radiation patch elements further comprises a length dimension, wherein a ratio of said length dimension to said width dimension of each of said first radiation patch elements is no greater than 2:1.

25. A dual-polarization planar antenna according to claim 14, wherein each of said second radiation patch elements further comprises a length dimension, wherein a ratio of said length dimension to said width dimension of each of said second radiation patch elements is no greater than 2:1.

26. A dual-polarization planar antenna comprising:

a first feeding substrate having a plurality of first radiation patch elements and a first feeding line, wherein each of said first radiation patch elements comprises a width dimension which is substantially greater than a width dimension of said first feeding line;

a first dielectric member;

a first ground conductor having a plurality of slots which correspond in position to said plurality of first radiation patch elements;

a second dielectric member;

a second feeding substrate having a plurality of second radiation patch elements which correspond in position to said plurality of first radiation patch elements and said plurality of slots, and a second feeding line, wherein each of said second radiation patch elements comprises a width dimension which is substantially greater than a width dimension of said second feeding line;

a third dielectric member;

a second ground conductor;

a fourth dielectric member; and a third ground conductor having a plurality of slots which correspond in position to said plurality of first radiation patch elements;

wherein said third ground conductor, said fourth dielectric member, said first feeding substrate, said first dielectric member, said first ground conductor, said second dielectric member, said second feeding substrate, said third dielectric member, and said second ground conductor are successively superposed in a direction from a top to a bottom of said dual-polarization planar antenna;

wherein said third ground conductor, said first feeding substrate, said first ground conductor, and said second feeding substrate are arranged so that said first radiation patch elements, said slots which correspond of said third and said first ground conductors, and said second radiation patch elements which correspond overlap with one another;

wherein respective pairs of said first and said second radiation patch elements are electromagnetically coupled to one another through said slots which correspond, respectively, each of said respective pairs being defined by one of said first radiation patch elements and one of said second radiation patch elements;

wherein said first and said second feeding substrates are arranged so that said first radiation patch elements are excited by said first feeding line in a first excitation direction while said second radiation patch elements are excited by said second feeding line in a second excitation direction perpendicular to said first excitation direction, whereby both vertical and horizontal polarizations are radiated.

27. A dual-polarization planar antenna as claimed in claim 20, wherein each of said first radiation elements has different dimensions in an excitation direction and a nonexcitation direction, said dimensions of said first radiation elements being determined in correspondence to polarized waves to be radiated.

28. A dual-polarization planar antenna as claimed in claim 26, wherein each of said second radiation elements has different dimensions in an excitation direction and a nonexcitation direction, said dimensions of said second radiation elements being determined in correspondence to polarized waves to be radiated.

29. A dual-polarization planar antenna as claimed in claim 26, wherein each of said first radiation elements and said second radiation elements has different dimensions in an excitation direction and a nonexcitation direction, said dimensions of said first radiation elements and said second radiation elements being determined independently of one another in correspondence to polarized waves to be radiated.

30. A dual-polarization planar antenna as claimed in claim 26, wherein said first and said second radiation elements have excitation phases controlled by said first and said second feeding lines, respectively, so that main beams exhibiting maximum gains for polarized waves to be radiated are oriented to different directions in correspondences to said polarized waves to be radiated.

31. A dual-polarization planar antenna as claimed in claim 26, wherein said first and said second radiation elements have excitation phases controlled by said first and said second feeding lines, respectively, so that an angle between 9 and 12 degrees is formed by main beams exhibiting maximum gains for said vertical and said horizontal linear polarizations.

32. A dual-polarization planar antenna as claimed in claim 26, wherein each slot of said third ground conductor has a shield portion formed at a position directly above said first feeding line and each slot of said first ground conductor comprises a shield portion formed at a position directly above said second feeding line.

33. A dual-polarization planar antenna as claimed in claim 26, wherein each of said first radiation elements has substantially equal dimensions in an excitation direction and a nonexcitation direction, and each of said second radiation elements has substantially equal dimensions in an excitation direction and a nonexcitation direction.

34. A dual-polarization planar antenna according to claim 26, wherein said width dimension of each of said first radiation patch elements is at least twice said width dimension of said first feeding line; and said width dimension of each of said second radiation patch elements is at least twice said width dimension of said second feeding line.

35. A dual-polarization planar antenna according to claim 26, wherein each of said first radiation patch elements further comprises a length dimension, wherein a ratio of said length dimension to said width dimension of each of said first radiation patch elements is no greater than 2:1.

36. A dual-polarization planar antenna according to claim 26, wherein each of said second radiation patch elements further comprises a length dimension, wherein a ratio of said length dimension to said width dimension of each of said second radiation patch elements is no greater than 2:1.

37. A dual-polarization planar antenna comprising:

a first feeding substrate having a plurality of first radiation patch elements for radiating a plurality of circularly polarized waves and a first feeding line, wherein each of said first radiation patch elements comprises a width dimension which is substantially greater than a width dimension of said first feeding line;

a first dielectric member;

a first ground conductor having a plurality of slots which correspond in position to said plurality of first radiation patch elements;

a second dielectric member;

a second feeding substrate having a plurality of second radiation patch elements, which correspond in position to said plurality of first radiation patch elements and said plurality of slots, for radiating a plurality of circularly polarized waves and a second feeding line, wherein each of said second radiation patch elements comprises a width dimension which is substantially greater than a width dimension of said second feeding line;

a third dielectric member; and a second ground conductor;

wherein said first feeding substrate, said first dielectric member, said first ground conductor, said second dielectric member, said second feeding substrate, said third dielectric member, and said second ground conductor are successively superposed in a direction from a top to a bottom of said dual-polarization planar antenna;

wherein said first feeding substrate, said first ground conductor, and said second feeding substrate are arranged so that said first radiation patch elements, said slots which correspond and said second radiation patch elements which correspond overlap with one another;

wherein respective pairs of said first and said second radiation patch elements are electromagnetically coupled to one another through said slots which correspond, respectively, each of said respective pairs being defined by one of said first radiation patch elements and one of said second radiation patch elements;

wherein said first and said second feeding substrates are formed so that said first and second radiation patch elements are oriented for radiating oppositely circularly polarized waves whereby both clockwise and counter-clockwise polarizations are radiated; and wherein dimensions of each of said first radiation patch elements are substantially equal to one another, and dimensions of each of said second radiation patch elements are substantially equal to one another.

38. A dual-polarization planar antenna as claimed in claim 37, wherein each of said first radiation elements has substantially equal dimensions in an excitation direction and a nonexcitation direction, and each of said second radiation elements has substantially equal dimensions in an excitation direction and a nonexcitation direction.

39. A dual-polarization planar antenna according to claim 37, wherein said width dimension of each of said first radiation patch elements is at least twice said width dimension of said second feeding line; and said width dimension of each of said second radiation patch element is at least twice said width dimension of said second feeding line.

40. A dual-polarization planar antenna according to claim 37, wherein each of said first radiation patch elements further comprises a length dimension, wherein a ratio of said length dimension to said width dimension of each of said first radiation patch elements is no greater than 2:1.

41. A dual-polarization planar antenna according to claim 37, wherein each of said second radiation patch elements further comprises a length dimension, wherein a ratio of said length dimension of said width dimension of each of said second radiation patch elements is no greater than 2:1.

42. A dual polarization planar antenna comprising:

a first feeding substrate having a plurality of first radiation patch elements and a first feeding line, wherein each of said first radiation patch elements comprises a width dimension which is substantially greater than a width dimension of said first feeding line;

a first dielectric member;

a first ground conductor having a plurality of slots which correspond in position to said plurality of first radiation patch elements;

a second dielectric member;

a second feeding substrate having a plurality of second radiation patch elements which correspond in position to said plurality of first radiation elements and said plurality of slots, and a second feeding line, wherein each of said second radiation patch elements comprises a width dimension which is substantially greater than a width dimension of said second feeding line;

a third dielectric member;

a second ground conductor; and a third ground conductor having a plurality of slots which correspond in position to said plurality of first radiation patch elements;

wherein said third ground conductor, said first feeding substrate, said first dielectric member, said first ground conductor, said second dielectric member, said second feeding substrate, said third dielectric member, and said second ground conductor are successively superposed in a direction from a top to a bottom of said dual-polarization planar antenna;

wherein said third ground conductor, said first feeding substrate, said first ground conductor, and said second feeding substrate are arranged so that said slots of said third conductor which correspond said first radiation patch elements, said slots of said first ground conductor which correspond and said second radiation patch elements which correspond overlap with one another;

wherein said first and said second feeding substrates are arranged so that said first radiation patch elements are excited by said first feeding line in a first excitation direction while said second radiation patch elements are excited by said second feeding line in a second excitation direction perpendicular to said first excitation direction, whereby both vertical and horizontal polarizations are radiated; and wherein each of said plurality of slots of said third ground conductor has a shield portion formed at a position directly above said first feeding line and each slot of said first ground conductor comprises a shield portion formed at a position directly above said second feeding line.

43. A dual-polarization planar antenna as claimed in claim 42, wherein dimensions of each of said first radiation elements are substantially equal to one another, dimensions of each of said second radiation elements are substantially equal to one another, each of said first radiation elements has substantially equal dimensions in an excitation direction and a nonexcitation direction, and each of said second radiation elements has substantially equal dimensions in an excitation direction and a nonexcitation direction. and

44. A dual-polarization planar antenna as claimed in claim 42, wherein said first and said second radiation elements have excitation phases controlled by said first and said second feeding lines, respectively, so that main beams exhibiting maximum gains for polarized waves to be radiated are oriented in different directions in correspondence to said polarized waves to be radiated.

45. A dual-polarization planar antenna as claimed in claim 42, wherein said polarized waves to be radiated are vertically and horizontally linearly polarized, wherein an angle between 9 and 12 degrees is formed by main beams exhibiting maximum gains for said vertical and said horizontal linear polarizations.

46. A dual-polarization planar antenna according to claim 42, wherein said width dimension of each of said first radiation patch elements is at least twice said width dimension of said first feeding line; and said width dimension of each of said second radiation patch elements is at least twice said width dimension of said second feeding line.

47. A dual-polarization planar antenna according to claim 42, wherein each of said first radiation patch elements further comprises a length dimension, wherein a ratio of said length dimension to said width dimension of each of said first radiation patch elements is no greater than 2:1.

48. A dual-polarization planar antenna according to claim 42, wherein each of said second radiation patch elements further comprises a length dimension, wherein a ratio of said length dimension to said width dimension of each of said second radiation patch elements is no greater than 2:1.

* * * * *

UNITED STATES PATENT AND TRADEMARK OFFICE

CERTIFICATE OF CORRECTION

PATENT NO. : 5,510,803

DATED : April 23, 1996

INVENTOR(S) : H. ISHIZAKA et al.

It is certified that error appears in the above-indentified patent and that said Letters Patent is hereby corrected as shown below:

On the cover, it is respectfully requested that a Certificate of Correction issue in the above-identified patent as follows:

On the cover, in section [56], "References Cited", "OTHER PUBLICATIONS", line 11, change "8133" to ---B133---.

At column 15, line 22 (claim 15, line 3), change "a" to ---an---.

At column 15, line 45 (claim 17, line 12), change "aid" to ---said---.

At column 17, line 30 (claim 27, line 2), change "20," to ---26,---.

At column 19, line 4 (claim 37, line 46), after "waves" insert ---,---.

At column 20, line 32 (claim 43, line 9), delete "and" (second occurrence).

Signed and Sealed this

Twenty-eighth Day of January, 1997

*Attest:*

Bruce Lehman

BRUCE LEHMAN

*Attesting Officer* *Commissioner of Patents and Trademarks*